US005510564A

United States Patent [19]

Raghuram et al.

[11] Patent Number: 5,510,564

[45] Date of Patent: Apr. 23, 1996

[54] N-PARAFFIN PURIFICATION PROCESS WITH REMOVAL OF AROMATICS

[75] Inventors: Srikantiah Raghuram, Buffalo Grove; Lawrence E. Sullivan, Mount Prospect, both of Ill.

[73] Assignee: UOP, Des Plaines, Ill.

[21] Appl. No.: 354,192

[22] Filed: Dec. 12, 1994

[51] Int. Cl.[6] ..... C07C 7/12; C07C 7/00

[52] U.S. Cl. ..... 585/822; 585/802; 585/804; 585/826; 585/827

[58] Field of Search ..... 585/802, 804, 585/822, 826, 827

[56] References Cited

U.S. PATENT DOCUMENTS

| | | | |
|---|---|---|---|
| 2,920,037 | 1/1960 | Haensel | 208/310 |
| 2,957,927 | 10/1960 | Broughton et al. | 260/676 |
| 3,455,815 | 7/1969 | Fickel | 208/310 |
| 4,184,943 | 1/1980 | Anderson | 208/310 R |
| 5,171,923 | 12/1992 | Dickson et al. | 585/821 |
| 5,220,099 | 6/1993 | Schreiner et al. | 585/820 |

*Primary Examiner*—Sharon Gibson

*Attorney, Agent, or Firm*—Thomas K. McBride; John G. Tolomei

[57] ABSTRACT

An integrated process for the production of normal paraffins from a feed mixture of normal paraffins, iso-paraffins and aromatics is disclosed. The process integrates a normal paraffin sorption process and an aromatics sorption process. The normal paraffin product of the process of our invention meets the commercial requirements for production of detergents, including sufficiently-low concentrations of both iso-paraffins and aromatics. The process achieves these results without the need for two additional factionation columns that are necessary to prior unintegrated processes.

16 Claims, 2 Drawing Sheets

N-PARAFFIN PURIFICATION PROCESS WITH REMOVAL OF AROMATICS

FIELD OF THE INVENTION

This invention relates to the separation of normal paraffins from a feed mixture containing normal paraffins, branched paraffins, and aromatics.

BACKGROUND OF THE INVENTION

Special commercial uses of normal paraffins require that the normal paraffins contain an especially low concentration of aromatics. By normal paraffins, it is meant straight-chain, linear or unbranched paraffins. One of these special uses is the manufacture of detergents made from alkylbenzenes, in which $C_{10}$–$C_{22}$ normal paraffins are dehydrogenated to olefins that are then used to alkylate benzene. The problems with aromatics in the normal paraffins, particularly aromatics having the same carbon number as the normal paraffins, arise during the alkylation step because of the occurrence of two side-reactions: first, the ring of the aromatic can react with an olefin to produce a heavy, dialkyl benzene by-product, and second the side-chain of the aromatic can be dehydrogenated and react with benzene to produce a heavy, biphenyl by-product. Either by-product is not suitable for detergents. These side-reactions result in waste of valuable feedstocks, costs for separation and disposal of by-products, and economic loss. For these reasons, there is sometimes a preference that the concentration of aromatics in normal paraffins used for commercial production of detergents be less than 0.005 wt-% (50 wppm) of the normal paraffins.

The most plentiful, commercial source of $C_{10}$–$C_{22}$ normal paraffins is crude oil, in particular the kerosene-range fraction. By "kerosene-range" is meant the boiling point range of 360°–530° F. (182°–277° C.). This fraction is a complex mixture comprising normal paraffins, iso-paraffins, and aromatics from which the normal paraffins cannot be separated using conventional distillation. Depending on the type of crude from which the hydrocarbon fraction is derived and the carbon number range of the fraction, the concentration of normal paraffins is usually 15–60 wt-% of the feed and the concentration of aromatics is usually 10–30 wt-% of the feed. There may be more unusual feed streams which have aromatic concentrations of only 2–4 wt-% of the feed.

The separation of various hydrocarbonaceous compounds through the use of selective sorbents is widespread in the petroleum, chemical and petrochemical industries. Sorption is often utilized when it is more difficult or expensive to separate the same compounds by other means such as fractionation. Examples of the types of separations which are often performed using selective sorbents include the separation of para-xylene from a mixture of xylenes, unsaturated fatty acids from saturated fatty acids, fructose from glucose, acyclic olefins from acyclic paraffins, and normal paraffins from isoparaffins. Typically, the selectively sorbed materials have the same number of carbon atoms per molecule as the non-selectively adsorbed materials and very similar boiling points. Another common application is the recovery of a particular class of hydrocarbons from a broad boiling point range mixture of two or more classes of hydrocarbons. An example is the separation of $C_{10}$ to $C_{14}$ normal paraffins from a mixture which also contains $C_{10}$ to $C_{14}$ iso-paraffins.

One of the principal prior art processes for the selective removal of the aromatics from the kerosene-range fraction employs a sorption process that separates the normal paraffins and the iso-paraffins. The sorbent used in this process has pores which the normal paraffins can enter, but which the aromatics, like the iso-paraffins, cannot enter because their cross-sectional diameter is too great. Contacting a kerosene-range feed with the sorbent produces a raffinate stream containing almost all of the iso-paraffins and aromatics that were in the feed, and a sorbent loaded with sorbed normal paraffins. Then, contacting the loaded sorbent with a desorbent stream produces an extract product containing almost all of the normal paraffins in the feed. But, sorbents used in this process are not ideally selective for normal paraffins, and where the sorbent comprises a crystalline zeolite and an amorphous binder, the binder itself may be selective for aromatics. Consequently, a small portion of the feed aromatics is rather tenaciously sorbed on the surfaces of the sorbent and ultimately appears as a contaminant in the extract (normal paraffin) product. With a typical kerosene-range feed and a commercial sorbent, the concentration of aromatics is usually 0.15–0.50 wt-% (1500–5000 wppm) of the extract product, which is sometimes unacceptably high for production of commercial detergents.

A variation on the process described in the preceding paragraph can reduce the concentration of aromatics to about 0.05 wt-% (500 wppm) of the extract product. The distinguishing feature of this process variation is the contacting of the sorbent with a flush stream after contacting the sorbent with the feed stream and prior to contacting the sorbent with the desorbent stream. The flush stream contains a compound, typically another aromatic hydrocarbon, which desorbs some of the feed aromatics that had become sorbed on the sorbent, but does not desorb normal paraffins. The effluent from the flushing step is combined with the raffinate stream, meaning that the desorbed aromatics ultimately appear in the iso-paraffin product instead of the extract (normal paraffin) product. Unfortunately, some of the feed aromatics are not desorbed by the aromatic flush compound, and moreover during some abnormal circumstances some of the aromatic flush compound can even appear as an aromatic contaminant in the extract product. Therefore, even when a flush step is used with a typical kerosene-range feed and a commercial sorbent, the concentration of aromatics is usually about 0.05–0.08 wt.-% (500–800 wppm) of the extract product, which is still ten times higher than the current preference of some producers of commercial detergents.

Another prior art process can reduce the concentration of aromatics in the kerosene-range fraction to the required concentration, but it has serious economic drawbacks because it performs the removal of aromatics from the normal paraffins independently of the removal of iso-paraffins from the kerosene-range fraction. Initially, this process removes the isoparaffins from the kerosene-range fraction, thereby producing a stream containing normal paraffins and aromatics. Then, the removal of the aromatics, which employs a sorbent that preferentially sorbs aromatics, begins with the sorbent loaded with a desorbent. The sorbent is contacted with the normal paraffins and aromatics, thereby desorbing the desorbent, producing a raffinate stream containing normal paraffins and the desorbent, and leaving the sorbent loaded with aromatics. Next, the sorbent is contacted with the desorbent, thereby producing an extract stream containing the aromatics and the desorbent. But, in order to recover the normal paraffins as product, to discard the aromatics, and to recycle the desorbent, two distillation columns are needed——one for fractionating the raffinate stream and another for fractionating the extract stream. These two distillation columns along their associated reboilers, condensers, and other equipment, significantly increase the capital and operating costs of this process for the removal of the feed aromatics, making it economically unattractive.

SUMMARY OF THE INVENTION

This invention is an integrated process for the production of normal paraffins from a feed mixture of normal paraffins, iso-paraffins and aromatics. Within a process for separating normal paraffins and iso-paraffins, this invention employs three streams that are used most advantageously during each of three separate functional steps for the removal of aromatics: (1) sorption of the aromatics on a sorbent that preferentially sorbs aromatics, (2) flushing or purging normal paraffins from the interstitial volume of the sorbent, and (3) desorbing the sorbed aromatics from the sorbent.

This invention successfully and economically integrates a normal paraffin sorption process and an aromatics sorption process. The normal paraffin product of the process of this invention meets the commercial requirements for production of detergents, including sufficiently-low concentrations of both iso-paraffins and aromatics. This invention achieves these results without the need for one or more additional fractionation columns that are necessary in the prior art processes.

In this invention, the raffinate column of the normal paraffin sorption process separates the desorbent component from the extract stream of the aromatics sorption process. In other words, the raffinate column of the normal paraffin sorption process also performs the function of the extract column of the aromatics sorption process. Thus, this invention integrates the functions of two columns into one column, thereby eliminating the need for a separate extract column for the aromatic sorption process. In this invention, the raffinate column of the paraffin sorption process is a source and destination for streams that contain the desorbent component of the aromatic sorption process. This allows the desorption of the sorbent of the aromatic sorption process to be integrated with the raffinate column of the paraffin sorption process.

It is an objective of this invention to provide a process for separating normal paraffinic hydrocarbons from a mixture of normal paraffinic hydrocarbons, iso-paraffinic hydrocarbons, and aromatic hydrocarbons, wherein integrated fractionation columns provide the fractionation requirements for a sorptive process that separates normal paraffinic hydrocarbons from a mixture of hydrocarbons as well as for a sorptive process that removes aromatic hydrocarbons from a mixture of hydrocarbons.

In one embodiment, this invention is a method of removing a co-boiling aromatic hydrocarbon within a process for separating a normal paraffinic hydrocarbon from a paraffin-feed stream comprising a normal paraffinic hydrocarbon, an isoparaffinic hydrocarbon, and a co-boiling aromatic hydrocarbon. The isoparaffinic hydrocarbon has more than 6 carbon atoms per molecule, and the normal paraffinic hydrocarbon has the same number of carbon atoms as the isoparaffinic hydrocarbon. The paraffin-feed stream, which is the feed stream for the paraffin sorption step, is passed to a fixed first bed of a solid first sorbent, and the normal paraffinic hydrocarbon and the co-boiling aromatic hydrocarbon are sorbed within the first bed. A paraffin-raffinate stream, which is the raffinate stream from the paraffin sorption step, comprises the isoparaffinic hydrocarbon and the first compound and is withdrawn from the first bed. A paraffin-desorbent stream, which is the desorbent stream for the paraffin desorption step, comprises a first compound and is passed to the first bed. The normal paraffinic hydrocarbon and the co-boiling aromatic hydrocarbon are desorbed from the first bed. A paraffin-extract stream, which is the extract stream from the paraffin desorption step, comprises the normal paraffinic hydrocarbon, the co-boiling aromatic hydrocarbon, and the first compound and is withdrawn from the first bed. A portion of the paraffin-extract stream is the feed stream for the aromatics sorption step and, therefore, may be referred to as the aromatic-feed stream. This portion of the paraffin-extract stream is passed to an aromatics removal zone that comprises a fixed second bed of a solid second sorbent, and is passed to the second bed in an aromatic sorption step. While the co-boiling aromatic hydrocarbons are sorbed from the portion of the paraffin-extract stream, a second compound is desorbed from the second sorbent. A first product stream comprising the normal paraffinic hydrocarbon is withdrawn from the aromatics removal zone. A first recycle stream comprising the first compound and a second recycle stream comprising the second compound are also withdrawn from the aromatics removal zone. A portion of the paraffin-raffinate steam is passed to a first separation zone. Recovered from the first separation zone are a second product stream comprising the isoparaffinic hydrocarbon and the co-boiling aromatic hydrocarbon, a third recycle stream comprising the first compound, and a fourth recycle stream comprising the second compound. An aromatic-desorbent stream, which is the desorbent stream for the aromatic desorption step, comprises at least a portion of the second recycle stream or a portion of the fourth recycle stream. The aromatic-desorbent stream is passed to a fixed third bed of the solid second sorbent in an aromatic desorption step. The co-boiling aromatic hydrocarbon is desorbed within the third bed while the second compound is sorbed within the third bed. An aromatic-extract stream which is the extract stream from the aromatic desorption step, comprises the co-boiling aromatic hydrocarbon and the second compound and is withdrawn from the third bed. A portion of the aromatic-extract stream is passed to the first separation zone. A portion of the first recycle stream or a portion of the third recycle stream is recovered as the paraffin-desorbent stream. The second and third fixed beds in the aromatic sorption and aromatic desorption steps are interchanged periodically.

In a second embodiment, this invention is a method of removing a co-boiling aromatic hydrocarbon within a process for separating a normal paraffinic hydrocarbon from a paraffin-feed stream comprising a normal paraffinic hydrocarbon, an isoparaffinic hydrocarbon, and a co-boiling aromatic hydrocarbon. The isoparaffinic hydrocarbon has more than 6 carbon atoms per molecule, and the normal paraffinic hydrocarbon has the same number of carbon atoms as the isoparaffinic hydrocarbon. The paraffin-feed stream which is the feed stream for the paraffin sorption step, is passed to a fixed first bed of a solid first sorbent, and within a paraffin sorption zone of the first bed, the normal paraffinic hydrocarbon and the co-boiling aromatic hydrocarbon are sorbed within the first bed. A paraffin-raffinate stream, which is the raffinate stream from the paraffin sorption step, comprises the isoparaffinic hydrocarbon and the first compound and is withdrawn from the first bed. A paraffin-desorbent stream, which is the desorbent stream for the paraffin desorption step, comprises a first compound and is passed to the first bed at a different point than the paraffin-feed stream is passed to the first bed. Within a paraffin desorption zone of the first bed, the normal paraffinic hydrocarbon and the co-boiling aromatic hydrocarbon are desorbed within the first bed. A paraffin-extract stream, which is the extract stream from the paraffin desorption step, comprises the normal paraffinic hydrocarbon, the co-boiling aromatic hydrocarbon, and the first compound, and is withdrawn from the first bed. Movement of the first bed is simulated by maintaining a net fluid flow through the first bed and by periodically moving in a unidirectional pattern the points at which the paraffin-feed stream and the paraffin-desorbent stream are passed to the first bed and the points at which the paraffin-extract stream and the paraffin-raffinate stream are withdrawn from the first bed. By this means, the location of the paraffin sorption and paraffin desorption zones are gradually shifted within the first bed. A portion of the paraffin-extract stream is the feed stream for the aromatics sorption step and, therefore, may be referred to as the aromatic-feed stream. This portion of the paraffin-extract stream is passed to an aromatics removal zone that comprises a fixed second bed of a solid second sorbent, and is passed to the second bed in an aromatic sorption step. While the co-boiling aromatic hydrocarbon is sorbed from the portion of the paraffin-extract stream, a second compound is desorbed from the second sorbent. A first product stream comprising the normal paraffinic hydrocarbon is withdrawn from the aromatics removal zone. A first recycle stream comprising the first compound and a second recycle stream comprising the second compound are also withdrawn from the aromatics removal zone. A portion of the paraffin-raffinate steam is passed to a first separation zone. Recovered from the first separation zone are a second product stream comprising the isoparaffinic hydrocarbon and the co-boiling aromatic hydrocarbon, a third recycle stream comprising the first compound, and a fourth recycle stream comprising the second compound. An aromatic-desorbent stream, which is the desorbent stream for the aromatic desorption step, comprises at least a portion of the second recycle stream or a portion of the fourth recycle stream. The aromatic-desorbent stream is passed to a fixed third bed of the solid second sorbent in an aromatic desorption step. The co-boiling aromatic hydrocarbon is desorbed within the third bed while the second compound is sorbed within the third bed. An aromatic-extract stream, which is the extract stream from the aromatic desorption step, comprises the co-boiling aromatic hydrocarbon and the second compound and is withdrawn from the third bed. A portion of the aromatic-extract stream is passed to the first separation zone. A portion of the first recycle stream or a portion of the third recycle stream is recovered as the paraffin-desorbent stream. The second and third fixed beds in the aromatic sorption and aromatic desorption steps are interchanged periodically.

INFORMATION DISCLOSURE

Examples of separation processes employing a bed of a solid adsorbent for separating normal or straight-chain paraffinic hydrocarbons form a mixture which also contains iso and/or cyclic hydrocarbons are described in U.S. Pat. Nos. 2,920,037 and 2,957,927.

Several commercial hydrocarbon separation processes utilize a simulated moving bed of a solid adsorbent. The operation of a simulated moving bed is well described in U.S. Pat. Nos. 2,985,589; 3,201,491; 3,291,726; and 3,732,325.

Methods of fractionating the extract and raffinate streams of a simulated moving bed adsorptive separation process are presented in U.S. Pat. No. 3,455,815 (Fickel), U.S. Pat. No. 4,006,197 (Bieser), and U.S. Pat. No. 4,184,943 (Anderson). The latter two references are specific to the separation of normal paraffins from iso-paraffins and aromatics using a multi-component desorbent.

A method of producing purified normal paraffins from a hydrocarbon stream which contains normal paraffins and aromatics is disclosed in U.S. Pat. No. 5,220,099 (Schreiner et al.)

A process of producing purified normal paraffins from a hydrocarbon stream which contains normal paraffins and aromatics is disclosed in U.S. Pat. No. 5,171,923 (Dickson et al.). The process employs an adsorbent bed and recycles components of the effluent streams from the bed during both adsorption and desorption, including desorbent materials.

A method of removing aromatic compounds from a mixture of paraffins, olefins, and aromatics using an adsorbent is disclosed in U.S. Pat. No. 5,276,231 (Kocal et al.)

DETAILED DESCRIPTION OF THE INVENTION

Figure 1:
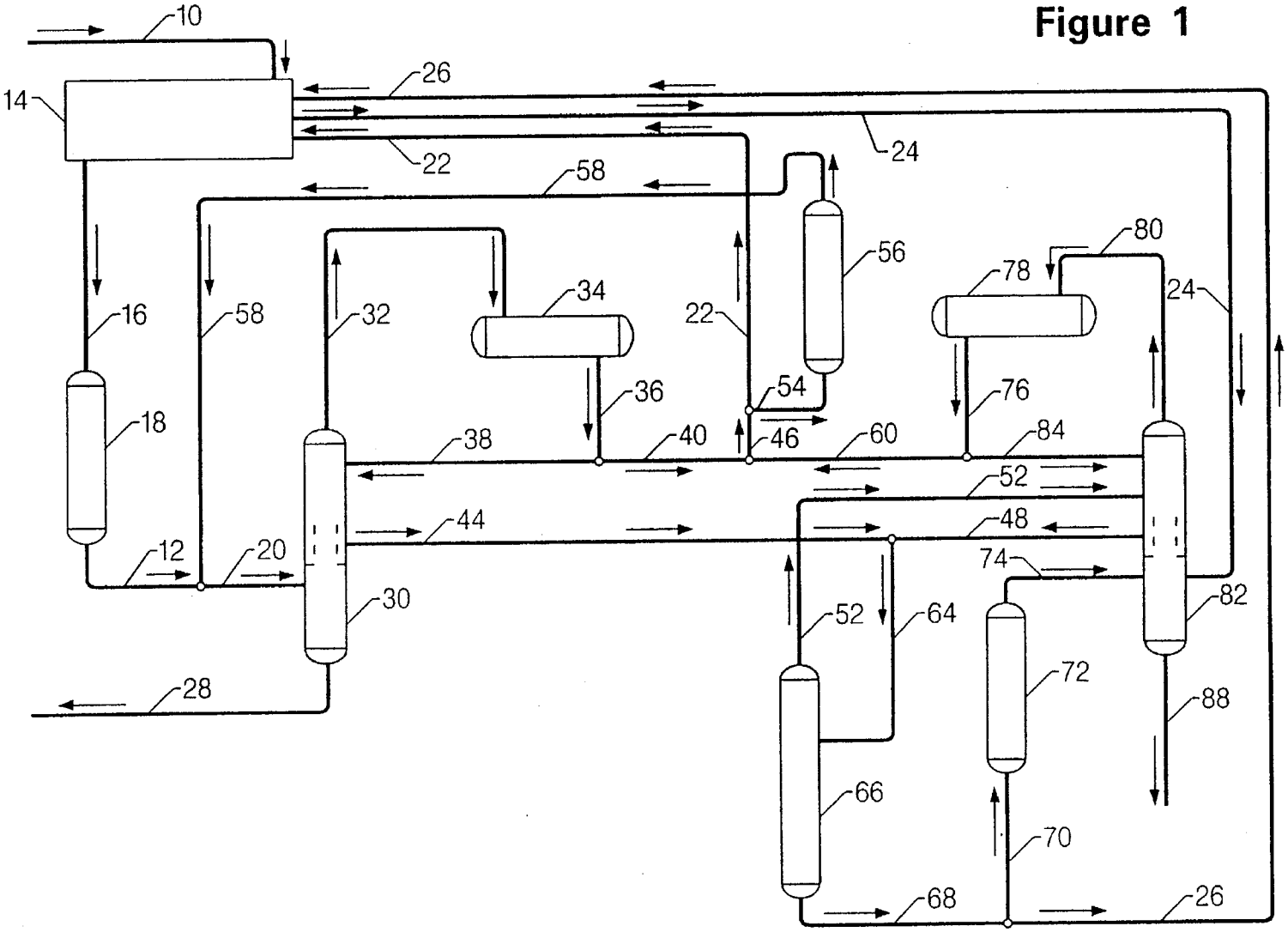
FIG. 1 is a simplified process flow diagram of one embodiment of the invention, wherein an aromatics removal zone sorbs aromatics from the normal paraffin-containing stream that enters the extract column of a process for separating normal paraffins and iso-paraffins.

The present invention integrates an aromatics sorption process into a normal paraffin sorption process in a manner that produces a normal paraffin product with a low concentration of aromatics. More specifically, in this invention three process streams which are present in a normal paraffin sorption process are employed very advantageously in an aromatics sorption process.

Prior to describing the details of the normal paraffin sorption process and the aromatics sorption process, it is helpful to define several terms that apply to both sorption processes.

The term "sorption" as used herein refers to either absorption, adsorption, or a combination of the two. The term "absorption" as used herein refers to the penetration of one substance into the inner structure of another substance. The term "adsorption" as used herein refers to the attraction to and holding of one substance to the surface of another substance.

As used herein, the term "feed stream" is intended to indicate a stream which comprises the feed material and which is charged to the bed of sorbent for the purpose of recovering the extract component. The feed stream will comprise one or more extract components and one or more raffinate components. An "extract component" is a chemical compound which is preferentially sorbed by the sorbent which is being used as compared to a "raffinate component."

The term "extract stream" refers to a stream which contains extract components that were originally contained in the feed stream and that have been desorbed from the bed of sorbent by the desorbent stream. The composition of the extract stream as it leaves the bed of sorbent will normally vary with time, and depending on conditions this composition can range from about 100 mole percent extract components to about 100 mole percent desorbent components.

The term "raffinate stream" is intended to indicate a stream originating at the bed of sorbent and which contains the majority of the raffinate components of the feed stream. The raffinate stream is basically the unsorbed components of the feed stream plus desorbent components which are picked up during passage through the sorption zone. The composition of the raffinate stream as it leaves the bed of sorbent will also vary with time from a high percentage of desorbent components to a high percentage of raffinate components. Both the extract stream and the raffinate stream are normally passed into separate backmixed accumulation zones before being passed into their respective fractionation columns.

As used herein the term "desorbent component" is intended to indicate a chemical compound capable of desorbing the extract component from the bed of sorbent. A "desorbent stream" is a process stream in which a "desorbent component" is carried to the bed of sorbent. The desorbent stream may be single-component, or it may be multi-component, by which it is meant that the desorbent stream may be a mixture of more than one desorbent component or a mixture of a desorbent component and one or more other chemical compounds. In this invention, the desorbent stream may be an admixture comprising a desorbent component and a flush component.

The term "flush component" is intended to refer to a chemical compound that is capable of removing substantial amounts of the raffiaate components from the interstitial void volume and the non-selective pore volume of the sorbent bed, but without desorbing substantial amounts of the extract components from the sorbent bed. A "flush stream" is a process stream that is passed to the sorbent bed after the passage of the feed stream to the sorbent bed and prior to the passage of the desorbent stream to the sorbent bed. The flush stream may be single-component or it may be multi-component. By multi-component it is meant that the flush stream may be a mixture of more than one "flush component," a mixture of a "flush component" and one or more other chemical compounds, or a mixture of a "flush component" and one or more desorbent components. The flush component generally makes up the bulk or balance of the composition of the flush stream, and the concentration of desorbent components if present is generally less than 40 vol-% of the flush stream.

The term "portion" as used herein in the context of a portion of a stream refers to either an aliquot portion having a composition that is similar to the stream or a fractional portion having a composition that is different from the stream, unless specifically stated.

Because this invention comprises two sorption processes and because each of the terms defined in the previous paragraphs can refer to either sorption process, it is convenient to hyphenate the terms in order to make clear which sorption process is being referred to when the terms are used. Therefore, terms that are preceded with "paraffin-" refer to paraffin sorption, such as "paraffin-sorbent" and "paraffin-desorbent stream." The terms that are preceded with "aromatic-" refer to the aromatic sorption, such as "aromatic-extract stream" and "aromatic-raffinate stream."

Generally sorptive separation processes comprise the sequential performance of three basic steps. First, the sorbent is brought into contact at sorption-promoting conditions with a feed stream comprising the particular compounds to be collected. This sorption step should continue for a time sufficient to allow the sorbent to collect a near equilibrium amount of the preferentially sorbed extract components. The second basic step is the contacting of the sorbent bearing both preferentially sorbed extract components and non-preferentially sorbed raffinate components with a flush component which flushes the latter from the sorbent. The second step is performed in a mariner which results in the sorbent containing significant quantities of only the preferentially sorbed extract components and the material used to flush the non-preferentially sorbed raffinate components. The third basic step of the sorptive separation process is the desorption of the preferentially sorbed extract components. This may be performed by changing the conditions of the temperature and pressure, but in the subject process it is performed by contacting the sorbent with a desorbent stream. The desorbent stream contains a desorbent component capable of desorbing the preferentially sorbed extract components and preparing the sorbent for another sorption step.

Generally, the contacting of the sorbent with either the feed stream, the flush stream, or the desorbent stream leaves the interstitial void spaces between the sorbent particles filled with the components of these particular streams. When the next contacting step begins, this residual liquid is admixed into the entering liquid. This results in the effluent stream removed from the sorbent bed being a mixture of compounds from the streams which were passed into the sorbent bed. Generally, two such effluent streams, which are referred to herein as the extract stream and the raffinate stream are produced. The extract stream comprises a mixture of the desorbent and the extract components, and the raffinate stream comprises a mixture of the desorbent with the raffinate components. Either the extract stream or the raffinate stream or both may comprise the flush component. In order to obtain a high purity stream of either the extract component or the raffinate component, and in order to recover the desorbent component and the flush component, it is necessary to fractionate these two effluent streams. The extract and raffinate streams are therefore fractionated in two separate ffactionation columns referred to herein as the extract column and the raffinate column, respectively.

In this invention, the normal paraffin sorption comprises one or more of three basic steps: (1) sorption of normal paraffins by a paraffin-sorbent, (2) flushing of non-sorbed components from the paraffin-sorbent, and (3) desorption of sorbed normal paraffins from the paraffin-sorbent. In order to perform these steps several diverse process streams may be circulated or passed to and from a variety of zones of the normal paraffin sorption process. This invention employs one or more of those process streams in order to perform one or more of the basic steps in an aromatics sorption process: (1) sorption of aromatics by an aromatic-sorbent that is different from the paraffin-sorbent, (2) flushing of non-sorbed components from the aromatic-sorbent, and (3) desorption of sorbed aromatics from the aromatic-sorbent. Consequently, in addition to performing normal paraffin sorption, this invention also performs aromatics sorption. Most importantly, this invention eliminates the need for one or more additional fractionation columns which an aromatics sorption process that is not integrated with a normal paraffin sorption process would otherwise require.

In this invention, the sequential sorption and desorption steps of a sorptive separatory process may be performed using a fixed bed of sorbent having fixed inlet and outlet points at opposite ends of the sorbent bed. However, certain benefits are obtained by using a simulated moving bed of sorbent. These benefits include the continuous production of a high purity product stream. Preferably, the countercurrent flow of the bed of solid sorbent and the various entering liquid streams, such as the feed and desorbent streams, is simulated.

In this invention, the normal paraffin sorption process is preferably performed using a countercurrent simulated moving bed process, and the aromatics sorption process is preferably performed using a fixed bed process that does not use a simulated moving bed. Although the following description is written in terms of the normal paraffin sorption being performed using a simulated moving bed process and the aromatics sorption being performed using a fixed bed that is not a simulated moving bed, it is to be understood that this description is not intended to limit the scope of the invention as claimed. This invention can be performed with other combinations of processes for the normal paraffin sorption and the aromatics sorption. For example, the normal paraffin sorption could be practiced in a fixed bed process, in a cocurrent, pulsed batch process, like that described in U.S. Pat. No. 4,159,284, or in a cocurrent, pulsed continuous process, like that disclosed in U.S. Pat. Nos. 4,402,832 and 4,478,721, both issued to Gerhold. Similarly, the aromatics sorption could be practiced in a countercurrent simulated moving bed process, in a cocurrent, pulsed batch process, or in a cocurrent, pulsed continuous process. In the normal paraffin sorption process of this invention, two separate actions are involved in the simulation of a moving bed of paraffin-sorbent. The first of these is the maintenance of a net fluid flow through the bed of paraffin-sorbent in a direction opposite to the direction of simulated movement of the paraffin-sorbent. This is performed through the use of a pump operatively connected in a manner to achieve this circulation along the length of the entire bed of paraffin-sorbent. The second action involved in simulating the movement of the paraffin-sorbent is the periodic actual movement of the location of the various zones, such as the sorption zone, along the length of the bed of paraffin-adsorbent. This actual movement of the location of the various zones is performed gradually in a unidirectional pattern by periodically advancing the points at which the entering streams enter the paraffin-sorbent bed and the points at which the effluent streams are withdrawn from the paraffin-sorbent bed. It is only the locations of the zones as defined by the respective feed and withdrawal points along the bed of paraffin-sorbent which are changed. The paraffin-sorbent bed itself is fixed and does not move.

The bed of paraffin-sorbent may be contained in one or more separate interconnected vessels. At a large number of points along the length of the bed of paraffin-sorbent, the appropriate openings and conduits are provided to allow the addition or withdrawal of liquid. At each of these points, there is preferably provided a constriction of the cross-section of the bed of paraffin-sorbent by a liquid distributor-collector. These may be similar to the apparatus described in the U.S. Pat. Nos. 3,214,247 and 3,523,762. These distributor-collectors serve to aid in the establishment and maintenance of plug flow of the fluids along the length of the bed of paraffin-sorbent. The two points at which any one stream enters and the corresponding effluent stream leaves the bed of paraffin-sorbent are separated from each other by at least two or more potential fluid feed or withdrawal points which are not being used. For instance, the feed stream may enter the sorption zone at one point and flow past nine potential withdrawal points and through nine distributor-collectors before reaching the point at which it is withdrawn from the paraffin-sorbent bed as the raffinate stream. The gradual and incremental movement of the sorption zone is achieved by periodically advancing the actual points of liquid addition or withdrawal to the next available potential point. That is, in each advance of the sorption zone, the boundaries marking the beginning and the end of each zone will move by the relatively uniform distance between two adjacent potential points of liquid addition or withdrawal.

The switching of the fluid flows at these many different locations may be achieved by a multiple-valve manifold or by the use of a multiple-port rotary valve. A central digital controller is preferably used to regulate the operation of the rotary valve or manifold. For simplicity, only the actual points of liquid addition and withdrawal are represented in the Drawings and the large number of potential transfer points and the required interconnecting lines between the rotary valve and the bed of sorbent have not been presented. Further details on the operation of a simulated moving bed of sorbent and the preferred rotary valves may be obtained from the previously cited references and from U.S. Pat. Nos. 3,040,777; 3,422,848; 2,957,485; 3,131,232; 3,268,604 and 3,268,605.

Solid paraffin-sorbents contemplated for use herein shall comprise shape-selective zeolites commonly referred to as molecular sieves. The term "shape selective" refers in the zeolite's ability to separate molecules according to shape or size because of zeolite's pores of fixed cross-sectional diameters. The zeolites belong to a group of aluminum silicate crystals having a framework structure in which every tetrahedron of $SiO_4$ or $AlO_4$ shares all its comers with other tetrahedra, thus accounting for all the silicon, aluminum and oxygen atoms in the structure. These crystals have a chemical formula in which the ratio (Si+Al):(O) is 1 to 2. Of the several types of known zeolites, only those having rigid frameworks are suitable molecular sieves. When originally formed the zeolite crystals contain water in the interstices defined by the framework. On moderate heating this water can be driven off and the open interstices are then of uniform size and can admit compounds whose maximum critical molecular diameters are not substantially greater than the minimum diameters of the interstices. The pure zeolite molecular sieves, particularly the synthetic ones, generally are produced in the form of soft, powdery masses of small crystals. For use in commercial processes these zeolite crystals may be composited with binder materials such as clays, alumina or other materials, to form stronger, more attrition-resistant particles.

Paraffin-sorbents contemplated for use in normal paraffin sorption will comprise zeolites having uniform pore diameters of 5 Angsttoms such as chabazite or particularly such as UOP's commercially-available type 5A molecular sieve. As obtained commercially, this latter material is usually in the form of an extrudate or a pellet or in granular form and contains pure 5A zeolite and a binder material such as clay. The paraffin-sorbent utilized in this process will generally be in the form of particles having a particulate size range of from about 20 to about 40 mesh size.

In the aromatics sorption process of this invention, the fixed bed of aromatic-sorbent may be installed in one or more vessels so that the flow of the aromatic-feed stream through the vessels is series flow, parallel flow, or both. Preferably, the flow of the aromatic-feed stream is performed in a parallel manner so that during sorption when one or more of the aromatic-sorbent beds is loaded with an accumulation of sorbed aromatics, the loaded bed may be bypassed while continuing uninterrupted sorption through one or more parallel aromatic-sorbent beds. The loaded aromatic-sorbent may then be flushed with an aromatic-flush stream and then desorbed with an aromatic-desorbent stream in order to prepare it for another sorption step. A preferred sequencing of fixed beds of aromatic-sorbent is to maintain at least one bed on sorption, at least one other bed on flushing, and at least one other bed on desorption. The conditions for flushing and desorption of the aromatic-sorbent are preferably selected so that the duration of the sorption, flushing, and desorption steps are all equal.

Suitable aromatic-sorbents may be selected from materials which exhibit the primary requirement of selectivity for the co-boiling aromatics and which are otherwise convenient to use. Suitable aromatic-sorbents include for example, zeolites, bound zeolites, molecular sieves, silica, activated carbon, activated charcoal, activated alumina, silica-alumina, clay, cellulose acetate, synthetic magnesium silicate, macroporous magnesium silicate, and/or macroporous polystyrene gel. It should be understood that the above-mentioned aromatic-sorbents are not necessarily equivalent in their effectiveness. "Bound zeolite" refers to a composite of the zeolite with a binder in order to provide a convenient form for use in the aromatic sorption process of this invention. The art teaches that silica-alumina clays are suitable binders. The choice of aromatic-sorbent will depend on several considerations including the capacity of the aromatic-sorbent to retain co-boiling aromatics, the selectivity, of the aromatic-sorbent to retain aromatics, and the cost of the aromatic-sorbent. The preferred aromatic-sorbent is a zeolite, and the preferred zeolite is 13X zeolite (sodium zeolite X). Detailed descriptions of zeolites may be found in the book authored by D. W. Breck entitled "Zeolite Molecular Sieves" published by John Wiley and Sons, N.Y. in 1974.

In accord with this invention the first basic step of aromatics sorption is performed by passing an aromatic-feed stream to a bed of aromatic-sorbent and sorbing an aromatic-extract component from the aromatic-feed stream. In accord with the previous definitions, the term "aromatic-feed stream" refers to the stream that is charged to the bed of aromatic-sorbent for the purpose of recovering the aromatic-extract component. The term "aromatic-extract component" refers to the aromatics that are preferentially sorbed by the aromatic-sorbent, as compared to the aromatic-raffinate component. In this invention, the term "aromatic-extract component" is synonymous with the undesired contaminants which, without the benefit of this invention, would be present at unacceptably high concentrations in the desired product of the process. The term "aromatic-raffinate component" refers to the paraffins that are not preferentially sorbed by the aromatic-sorbent.

In the broad embodiment of this invention, the aromatic-feed stream is a portion of the paraffin-extract stream, which is withdrawn from a bed of paraffin-sorbent that has been first contacted with a paraffin-feed stream and subsequently contacted with a paraffin-desorbent stream. The term "paraffin-feed stream" as used herein refers to the stream that is charged to the bed of paraffin-sorbent for the purpose of recovering the paraffin-extract component. The term "paraffin-extract component" refers to the normal paraffins that are preferentially sorbed by the paraffin-sorbent, as compared to the paraffin-raffinate component. In this invention, the term "paraffin-extract component" is synonymous with the desired product of the process. The term "paraffin-raffinate component" refers to the isoparaffins that are not preferentially sorbed by the paraffin-sorbent.

The paraffin-feed stream comprises hydrocarbon fractions having a carbon number range of from about 6 carbon atoms per molecule to about 30 carbon atoms per molecule. Preferably, the carbon number range of the paraffin-feed stream is rather narrow and varies by only about 3 to 10 carbon numbers. A hydrotreated $C_{10}$ to $C_{15}$ kerosene fraction or a $C_{10}$ to $C_{20}$ gas oil fraction are representative paraffin-feed streams. The paraffin-feed stream may contain normal paraffins. isoparaffins and aromatics but is preferably free of olefins or has a very low olefin concentration. The concentration of normal paraffins in the paraffin-feed stream may vary from about 15 to about 60 vol. %. The concentration of the aromatics is typically from about 10–30 vol. % but may be as low as 2–4 vol. %. These paraffin-feed aromatics may be monocyclic aromatics such as benzene or alkylbenzenes and bicyclic aromatics including naphthalenes and biphenyls. The aromatic hydrocarbons have boiling points falling within the boiling point range of the desired paraffin-extract components of the paraffin-feed stream and are referred to as "co-boiling aromatic hydrocarbons" or simply "co-boiling aromatics."

During the sorption of normal paraffins from the paraffin-feed stream, a small but definite amount of the co-boiling aromatics present in the paraffin-feed stream will be sorbed on the external surfaces of the paraffin-sorbent particles. When the normal paraffins are desorbed from the paraffin-sorbent, a small but definite amount of the co-boiling aromatics present on the paraffin-sorbent will be desorbed from the paraffin-sorbent. The paraffin-desorbent stream that is used to desorb the normal paraffins comprises a paraffin-desorbent component. Thus the paraffin-extract stream that is withdrawn from the bed of sorbent may comprise normal paraffins and co-boiling aromatics that were originally in the paraffin-feed stream and the paraffin-desorbent component. The paraffin-desorbent component generally comprises any normal paraffin having a boiling point different from the normal paraffins in the paraffin-feed stream and which is a flee-flowing liquid at process conditions. Normal pentane is preferred as the paraffin-desorbent component for the recovery of normal paraffins having 9 or more carbon atoms per molecule.

How the aromatic-feed stream is produced from the paraffin-extract stream is different in the two more-limited embodiments of this invention. In the first embodiment, the aromatic-feed stream is the paraffin-extract stream, and in the other embodiment the aromatic-feed stream is the bottoms stream of the paraffin-extract column, which separates the paraffin-extract stream.

In the first more-limited embodiment of this invention, the aromatic-feed stream is the paraffin-extract stream. In this embodiment, the paraffin-extract stream is charged to the bed of aromatic-sorbent, and the co-boiling aromatics, which are aromatic-extract components, are sorbed onto the aromatic-sorbent, while an aromatic-desorbent component is desorbed from the aromatic-sorbent. The normal paraffins in the aromatic-feed stream are aromatic-raffinate components and with the paraffin-desorbent component are therefore, present in the aromatic-raffinate stream that is withdrawn from the aromatic-sorbent. The aromatic-raffinate stream contains a decreased concentration of co-boiling aromatics and an increased concentration of the aromatic-desorbent component compared to the aromatic-feed stream. The aromatic-raffinate stream is passed to the paraffin-extract column.

The paraffin-extract column separates the aromatic-raffinate stream into one or more streams that comprise the paraffin-desorbent component and the aromatic-desorbent component, and a product stream that comprises the normal paraffins that is the desired product of the process. The product stream may contain less than 100 w-ppm co-boiling aromatics as measured by ultraviolet spectroscopy. Therefore, in effect, the paraffin-extract column performs two functions: it not only separates the paraffin-desorbent component from the paraffin-extract stream, which is the conventional function of the paraffin-extract column, but it also separates the aromatic-desorbent component from the aromatic-raffinate stream, which is the conventional function of an aromatic-raffinate column. Thus, this embodiment of the invention integrates the functions of two colunms into one column, thereby eliminating the need for a separate aromatic-raffinate column.

In the second more-limited embodiment of this invention, the aromatic-feed stream is the net bottom stream of the paraffin-extract column. In this embodiment, the paraffin-extract stream is charged to the paraffin-extract column, and the net bottom stream comprises the normal paraffins and the co-boiling aromatics. The paraffin-extract column operates at conditions to reject substantially all of the paraffin-desorbent component and the aromatic-desorbent component in one or more net overhead or sidecut streams from the column, so that the net bottom stream contains insignificantly small concentrations of these components. The net bottom stream is charged to the bed of aromatic-sorbent, the co-boiling aromatics are sorbed onto the aromatic sorbent, and the aromatic-desorbent component is desorbed from the aromatic-sorbent. The aromatic-raffinate stream contains the normal paraffins and, compared to the net bottom stream, a decreased concentration of co-boiling aromatics and an increased concentration of aromatic-desorbent component. The aromatic-raffinate stream is passed to the aromatic-raffinate column.

The aromatic-raffinate column separates the aromatic-raffinate stream into a net overhead stream that comprises the aromatic-desorbent component and a net bottoms stream that comprises the normal paraffin and is the desired product stream of the process. The net bottoms stream may contain less than 500 w-ppm co-boiling aromatics, and preferably less than 50 w-ppm co-boiling aromatics, as measured by ultraviolet spectroscopy. The net overhead stream may be recycled to one of several locations in the process, including the paraffin-extract column. Although the paraffin-extract column separates the paraffin-desorbent component and the aromatic-desorbent component from the paraffin-extract stream as in the first more-limited embodiment, an additional aromatic-raffinate column is required to separate the aromatic-desorbent component from the aromatic-raffinate stream. This is the reason why, although both limited embodiments have the advantages of eliminating at least one fractionation column compared to the prior art processes, the first more-limited embodiment has the advantage of eliminating one more fractionation column than the second more-limited embodiment.

Either an aliquot portion or a fractional portion of any of the streams recovered from the paraffin-extract column that comprise the paraffin-desorbent component can provide at least a portion of the paraffin-desorbent stream. Similarly, a portion of any of the streams recovered from the paraffin-extract column that comprise the aromatic-desorbent component can provide at least a portion of the aromatic-desorbent stream. In one embodiment of the invention, the paraffin-extract column alone, or the paraffin-extract column in conjunction with at least one other column, produces more than one stream comprising the paraffin-desorbent component and the aromatic-desorbent component with each stream having different concentrations of the paraffin-desorbent component and of the aromatic-desorbent component. For example, the paraffin-extract column may produce an overhead stream that has a relatively high concentration of the paraffin-desorbent component and a relatively low concentration of the aromatic-desorbent component, and a sidecut stream that has a relatively low concentration of the paraffin-desorbent component and a relatively high concentration of the aromatic-desorbent component. In this case, the paraffin-desorbent stream may comprise an aliquot portion of the overhead stream and the aromatic-desorbent stream may comprise an aliquot portion of the sidecut stream From the previous description, depending on the embodiment of this invention either the paraffin-extract stream or the aromatic-raffinate stream is passed into an intermediate point of a fractionation column that has been referred to hereinbefore as the paraffin-extract column. By intermediate point, it is meant that the feed point to the paraffin-extract column is separated from both extremities of the paraffin-extract column by at least four fractionation trays. In either embodiment, the paraffin-extract components of the stream that is fed to the paraffin-extract column are the heaviest materials fed to the paraffin-extract column. Therefore, the paraffin-extract components of the stream that is passed to the paraffin-extract column are removed from the process as the net bottoms stream of the paraffin-extract column. Of course, in the case of the embodiment of this invention where the paraffin-extract stream passes to the extract column, the net bottoms stream of the paraffin-extract column also contains the co-boiling aromatics, because by definition these co-boiling aromatics are as heavy as the paraffin-extract components.

Following an appropriate sorption period for the aromatics-sorbent, which will depend on the composition of the aromatic-feed stream, the sorption conditions, and the particular co-boiling aromatics themselves, it is necessary to desorb the co-boiling aromatics from the aromatic-sorbent so that the aromatic-sorbent may be reused for aromatics-sorption. During aromatic-desorption, the aromatic-sorbent is contacted with an aromatic-desorbent stream comprising the aromatic-desorbent component. The aromatic-desorbent stream may be provided from a portion of one of the streams that contains the aromatic-desorbent component recovered from the paraffin-extract column, as described previously. Similarly, the aromatic-desorbent stream may also be provided from a portion of one of the streams that contains the aromatic-desorbent component recovered from the paraffin-raffinate column, as desorbed below.

During the sorption of normal paraffins from the paraffin-feed stream, an amount of the paraffin-desorbent component on the sorbent will be desorbed from the surfaces of the paraffin-sorbent particles. Thus, the paraffin-raffinate stream that is withdrawn from the bed of paraffin-sorbent comprises the isoparaffins and most but not all of the co-boiling aromatics from the paraffin-feed stream, as well as the paraffin-desorbent component. The paraffin-raffinate stream is charged into an intermediate point of the paraffin-raffinate column, and the net bottom stream comprises the isoparaffins and the co-boiling aromatics. The paraffin-raffinate column operates at conditions to reject substantially all of the paraffin-desorbent component in one or more net streams withdrawn from the column at a point above the column's feed point, so that the net bottoms stream contains insignificantly small concentrations of the paraffin-desorbent component. What has just been described is the conventional function of the paraffin-extract column, namely separating the paraffin-desorbent component from the paraffin-raffinate stream.

In this invention the paraffin-raffinate column performs an additional function: it separates the aromatic-desorbent component from the aromatic-extract stream, which is the conventional function of an aromatic-extract column. Thus, in all of its embodiments this invention integrates the functions of two columns into one column, thereby eliminating the need for a separate aromatic-extract column. This invention achieves this advantage in three steps: first, by passing the aromatic-extract stream to the paraffin-raffinate column; second, by recovering a stream comprising the aromatic-desorbent component from the paraffin-raffinate column; and, third, by recycling a portion of that recovered stream as the aromatic-desorbent stream. Thus, in this invention, the paraffin-raffinate column acts not only as a source of, but also as a destination for, streams that comprise the aromatic-desorbent component, thereby allowing the desorption of the aromatic-sorbent to be integrated with the paraffin-raffinate column.

During the desorption of the co-boiling aromatics from the aromatic-sorbent, the aromatic-extract stream that is withdrawn from the bed of aromatic-sorbent comprises the co-boiling aromatics from the aromatic-feed stream and the aromatic-desorbent compound. The aromatic-extract stream is charged into an intermediate point of the paraffin-raffinate column below the point where the streams that comprise the paraffin-desorbent component or the aromatic-desorbent component are withdrawn. The co-boiling aromatics, which by definition boil in the same boiling range as the isoparaffins, pass downward through the paraffin-raffinate column and leave the column in the net bottom stream. The paraffin-raffinate column rejects substantially all of the aromatics-desorbent component in one or more net streams withdrawn from the column at a point above the column's feed point. The net bottoms stream of the paraffin-raffinate column contains insignificantly small concentration of the aromatic-desorbent component. A portion of any of the streams recovered from the paraffin-raffinate column that comprise the aromatic-desorbent component can provide at least a portion of the aromatic-desorbent stream. Likewise, a portion of any of the streams recovered from the paraffin-raffinate column that comprise the paraffin desorbent component can provide at least a portion of the paraffin-desorbent stream. Thus, the operation of the upper section of the paraffin-raffinate column is similar in some respects to the operation of the upper section of the paraffin-extract column desorbed previously. Accordingly, in one embodiment of this invention, the paraffin-desorbent stream may comprise an aliquot portion of a paraffin-raffinate column overhead stream having a relatively high concentration of the paraffin-desorbent component, and the aromatic-desorbent stream may comprise the aliquot portion of a paraffin-raffinate column sidecut stream having a relatively high concentration of the aromatic-desorbent component.

It may be preferred, after the sorption of the co-boiling aromatics onto the aromatic-sorbent and prior to the desorption of the co-boiling aromatics from the aromatic-sorbent, to perform an additional step for the flushing of the aromatic-sorbent. Flushing of the aromatic-sorbent flushes aromatic-raffinate components from the interstitial void volume and the non-selective pore volume of the aromatic-sorbent. Flushing may be preferred for three reasons. First, the aromatic-raffinate components comprise normal paraffins that are the desired product of the process. Second, if the normal paraffins are not flushed from the aromatic-sorbent prior to desorption of the co-boiling aromatics, then the normal paraffins will be flushed to the paraffin-raffinate column during the desorption of the co-boiling aromatics. And third, normal paraffins that do enter the paraffin-raffinate column leave the process via the net bottom stream and are, therefore, lost, valuable product.

Flushing the aromatic-sorbent is performed by contacting the aromatic-sorbent with an aromatic-flush stream. The aromatic-flush stream may be any stream that contains an insignificant concentration of aromatic-desorbent components, paraffin-extract components, paraffin-raffinate components, and co-boiling aromatics. By an insignificant concentration of aromatic-desorbent components, it is meant that the concentration of the aromatic-desorbent component is less than 5 mol-%, preferably less than 2 mol-%, and more preferably less than 1 mol-%. A low concentration of aromatic-desorbent components in the aromatic-flush stream is desired in order to prevent the co-boiling aromatics from desorbing from the aromatics-sorbent at aromatic flushing conditions. Paraffin-extract components are not desired or even useful in the aromatic-flush stream, because paraffin-extract components comprise the same normal paraffins that the aromatic-flushing is intended to flush from the aromatic-sorbent. Paraffin-raffinate components are not desired in the aromatic-flush stream because, consequently, the aromatic-flush effluent stream would comprise a mixture of paraffin-raffinate components and paraffin-extract components which would at least partially defeat the purpose of the paraffin sorptive separation step. Similarly, if co-boiling aromatics were present in the aromatic-flush stream, the aromatic-flush effluent stream would comprise a mixture of co-boiling aromatics and paraffin-extract components, which would at least partially defeat the purpose of the aromatic sorptive separation step. For these reasons, the aromatic-flush stream preferably comprises the paraffin-desorbent component and the hereinafter-described paraffin-flush component.

The aromatic-flush stream is preferably formed from a portion of a net overhead stream that comprises the paraffin-desorbent component that is recovered from either the paraffin-extract column or the paraffin-raffinate column. Alternatively and preferably, the aromatic-flush stream may be formed from a portion of the paraffin-desorbent stream. In order to ensure that the aromatic-flush stream contains a sufficiently-low concentration of the aromatic-desorbent component, any of these three streams may be passed to a desorbent splitter column. The desorbent splitter column operates at conditions to reject substantially all of the aromatic-desorbent component from the column, usually in a net bottom stream, so that a net stream, usually a net overhead stream, contains insignificantly small concentrations of the aromatic-desorbent component. This net overhead stream becomes the aromatic-flush stream.

The aromatic-flush stream is charged to the bed of aromatic-sorbent and the normal paraffins are flushed from the bed, leaving the interstitial void volume and/or the non-selective pore volume of the aromatic-sorbent filled with the paraffin-desorbent component, and in some embodiments, the paraffin-flush component. The aromatic-flush effluent stream contains the normal paraffins and the paraffin-desorbent component, and it may contain the paraffin-flush component. The aromatic-flush effluent stream is passed to the paraffin-extract column. As described previously, the paraffin-extract column separates the normal paraffins from the paraffin-desorbent component, the normal paraffins leave the column in the net bottom stream and the paraffin-desorbent component, with the paraffin-flush component when present, in one or more of the net overhead or sidecut streams.

A paraffin-flush step is a preferred, but not essential, step in the invention. That is, it may be preferred to flush the paraffin-sorbent after the sorption of the normal paraffins onto the paraffin-sorbent and prior to the desorption of the normal paraffins from the paraffin-sorbent. Flushing the non-preferentially sorbed isoparaffins from the paraffin-sorbent, and recovering the paraffin-flush effluent with the paraffin-raffinate stream, ultimately increases the quantity of normal paraffins that are recovered ultimately in the normal paraffin product stream. This advantageous result occurs with a paraffin flush because the normal paraffins that are desorbed from the aromatic-sorbent at the start of the paraffin-desorption step are not mixed in with, and ultimately rejected with, isoparaffins that are in the interstitial void volume and the non-selective volume of the aromatic-sorbent at the end of the paraffin-sorption step.

Flushing the paraffin-sorbent is performed by contacting the paraffin-sorbent with a paraffin-flush stream. The paraffin flush stream contains a paraffin-flush component, which is usually an isoparaffin, so that it is not preferentially sorbed by the paraffin-sorbent. In addition, the paraffin-flush component usually has at least two fewer carbon atoms, and a boiling point at least 10° F. less than, and preferably at least 15° F. less than, the isoparaffins in the feed, so that it is easily distilled from the isoparaffins in the feed and recycled. The paraffin-flush stream generally contains insignificant concentrations of the paraffin-desorbent component, so that the normal paraffins are not prematurely desorbed prior to the paraffin-desorption step.

Where a paraffin-flush stream is employed in this invention, the paraffin-flush component is present in the paraffin-extract stream and in the paraffin-raffinate stream. Consequently, the paraffin-flush component is present in the paraffin-extract column, regardless of which stream the co-boiling aromatics are removed from, as well as in the paraffin-raffinate column. In the broadest aspect of this embodiment, the paraffin-flush component is recovered in one or more of the streams that comprise the aromatic-desorbent component and that are recovered from the paraffin-extract column or the paraffin-raffinate column. For example, a sidecut stream comprising the paraffin-flush component and the aromatic-desorbent component may be withdrawn from each of the paraffin-extract column and the paraffin raffinate column. The aromatic-desorbent stream may be provided from a portion of either sidecut stream, and likewise the paraffin-flush stream may be provided from a portion of either sidecut stream. The concentration of the aromatic-desorbent component in the paraffin-flush stream is generally between 10–60 vol.-%, and preferably between 20–50 vol. %. These preferred ranges of concentrations of the aromatic-desorbent component in the paraffin-flush stream help to ensure that the paraffin-flush stream does not function as an aromatic-desorbent stream for the co-boiling aromatics that are sorbed on the paraffin-sorbent. To the extent that the paraffin-flush stream does desorb co-boiling aromatics from the paraffin-sorbent, the co-boiling aromatics will appear ultimately in the paraffin-raffinate stream. Of course, this result is not entirely undesirable because the co-boiling aromatics would be rejected from the process in the net bottoms stream from the paraffin-raffinate column. Nevertheless, the volume of the circulating paraffin-flush stream would be unnecessarily large to the extent that the concentration of aromatic-desorbent in the paraffin-flush stream is high.

The paraffin-flush component of the paraffin-flush stream is preferably a paraffin-raffinate-type component which differs sufficiently in boiling point from the paraffin-raffinate components of the paraffin-feed stream. Preferably, the boiling point of the paraffin-flush component differs from the lowest boiling point of the normal paraffins, isoparaffins, and co-boiling aromatics in the paraffin-feed stream by at least 20° F. This allows the paraffin-flush component to be readily separated from the paraffin-raffinate stream by fractionation. The paraffin-flush component may be selected from the higher or lower boiling homologs of the isoparaffins or naphthenes in the paraffin-feed stream. Isooctane is a preferred paraffin-flush component for use in the separation of normal paraffins from a $C_{10}$ to $C_{15}$ paraffin-feed stream or a similar fraction. Isooctane is not preferentially sorbed by the paraffin-sorbent and is easily fractionated from the $C_{10}$ to $C_{15}$ paraffin-raffinate components of the paraffin-raffinate stream.

The aromatic-flush component of the aromatic-flush stream is preferably a paraffin-raffinate-type component which differs sufficiently in boiling point from the aromatic-raffinate components of the aromatic-feed stream to be effectively separated via fractionation. Because the aromatic-raffinate components are the normal paraffins of the paraffin-feed stream, and the paraffin-raffinate components are the isoparaffins of the paraffin feed stream, this preference for the boiling point of the aromatic-flush component is equivalent to the preference stated previously for the paraffin-flush component. Therefore, the aromatic-flush component may be the same compound as the paraffin-flush component. Consequently, isooctane is a preferred aromatic-flush component for use in the separation of aromatics from a $C_{10}$ to $C_{15}$ aromatic-feed stream. Isooctane is not preferentially sorbed by the aromatic-sorbent.

The aromatic-desorbent component is preferably an aromatic hydrocarbon which has a different boiling point than the aromatic-feed mixture and the aromatic-flush component of the aromatic-flush stream to facilitate easy separation of the aromatic-desorbent component from these materials. Preferably, the boiling point of the aromatic-desorbent component differs from the lowest boiling point of the normal paraffins, isoparaffins, and co-boiling aromatics in the paraffin-feed stream by at least 10° F. From the previous desorption, however, in some embodiments of this invention the paraffin-flush stream may be a mixture of the paraffin-flush component and the aromatic-desorbent component, and moreover the paraffin-flush component and the aromatic-flush component may be the same compound. In these embodiments, the aromatic-desorbent component may have a boiling point that is relatively close to that of the aromatic-flush component. Nevertheless, even in these embodiments, the separation of the aromatic-flush component from the aromatic-desorbent component is preferably sufficiently easy that an aromatic-flush stream having a relatively high concentration of the aromatic-flush component and a relatively low concentration of the aromatic-desorbent component can be achieved by means of conventional distillation. Generally, the aromatic-desorbent component preferably has two fewer carbon atoms than the lowest molecular weight aromatic-extract component of the aromatic-feed stream which it is desired to recover. A $C_8$ aromatic is specifically preferred for use during the separation of a $C_{10}$ to $C_{15}$ aromatic-feed stream.

The paraffin-desorbent component may comprise any normal paraffin having a boiling point different from the normal paraffins in the paraffin-feed stream and which is a free flowing liquid at a process conditions. Preferably, the paraffin-desorbent component has a lower boiling point and has fewer carbon atoms per molecule than the aromatic-desorbent component or the paraffin-flush component. Preferably, the boiling point of the paraffin-desorbent component differs from the lowest boiling point of the normal paraffins, isoparaffins, and co-boiling aromatics in the paraffin-feed stream by at least 30° F. Preferably, the boiling point of the paraffin-desorbent component differs from the boiling point of the aromatic-desorbent component by at least 20° F. Normal pentane is preferred as the paraffin-desorbent component for the recovery of normal paraffins having 9 or more carbon atoms per molecule.

In one embodiment of this invention, the three compounds of the paraffin-desorbent stream and the paraffin-flush stream are normal pentane, isooctane, and paraxylene. Normal pentane is the lightest-boiling of the three compounds, is the paraffin-desorbent component, and is also an aromatic-flush component. Isooctane is the intermediate-boiling compound, is a paraffin-flush component, and is also an aromatic-flush component. Finally, paraxylene is the heaviest-boiling of the three compounds, is the aromatic-desorbent component, and is also a paraffin-flush component.

Operating conditions for normal paraffin sorption, flushing, and desorption are as follows. Although normal paraffin sorptive separation processes can be operated with both vapor-phase and liquid-phase conditions, the use of liquid-phase conditions is preferred. Sorption-promoting conditions therefore preferably include a pressure sufficient to maintain all of the chemical compounds present in the sorbent bed as liquids. A pressure of from atmospheric to about 50 atmospheres may be employed with the pressure preferably being between 1.0 and 32 atmospheres gauge. Suitable operating temperatures range from 40° C. to about 250° C.

Those skilled in the art are able to select the appropriate conditions for operation of the aromatics-sorbent for aromatics-sorption without undue experimentation. Aromatics-sorption conditions generally include a temperature from about 20° C. (68° F.) to about 300° C. (572° F.), and preferably from about 100° C. (212° F.) to about 200° C. (392° F.), a pressure effective to maintain the aromatic-feed stream in a liquid phase at the chosen temperature, and a liquid hourly space velocity from about 1 $hr^{-1}$ to about 10 $hr^{-1}$ and preferably from about 1 $hr^{-1}$ to about 3 $hr^{-1}$. The flow of the stream containing the co-boiling aromatics through the aromatics removal zone may be conducted in an upflow, downflow, or radial-flow manner.

Although both liquid and vapor phase operations can be used in many sorptive separation processes, liquid phase operation is preferred for aromatics-sorption because of the lower temperature requirements and because of the higher sorption yields of the co-boiling aromatics that can be obtained with liquid phase operation over those obtained with vapor phase operation. Therefore, the temperature and pressure of the aromatic-sorbent during aromatics sorption are preferingly selected to maintain the aromatic-feed stream in a liquid phase. Alternatively, the temperature and pressure of the aromatic-sorbent during aromatics-sorption can be selected to maintain the co-boiling aromatics in a liquid phase in the aromatic-feed stream. Mixed phases (i.e., a combination of a liquid phase and a vapor phase) for the aromatic-feed stream are generally not preferred, however, because of the well-known difficulties involved in maintaining uniform flow distribution of both a liquid phase and a vapor phase through a sorptive separation zone. However, the sorption conditions of the aromatic-sorbent can be optimized by those skilled in the art to operate over wide ranges, which are expected to include the normal operating conditions of both the paraffin-extract stream and the bottoms stream of the paraffin-extract column.

Operating conditions for desorption from the aromatics-sorbent include a temperature of generally 20°–300° C. (68°–572° F.), and preferably 100°–200° C. (212°–392° F.), preferably at a pressure from atmospheric pressure to a pressure effective to maintain the aromatic-desorbent stream and the desorbed co-boiling aromatics in a liquid phase at the chosen temperature, and a liquid hourly space velocity of generally 1–10 $hr^{-1}$, and preferably 1–3 $hr^{-1}$. More preferably, the temperature for aromatics desorption is essentially the same as the temperature for aromatics sorption. The flow direction of the aromatic-desorbent stream through the aromatic-sorbent may be upflow, downflow, or radial flow. The flow direction of the aromatic-desorbent stream may be co-current to the flow direction of the aromatic-feed stream, but the preferred direction is counter-flow. The aromatic-desorbent stream may be liquid phase, vapor phase, or a mixture of liquid and vapor phases.

Operating conditions for flushing the aromatics-sorbent with the aromatic-flush stream generally comprise the operating conditions for sorption of the aromatics from the aromatics-feed stream. More specifically, the aromatic-flush stream contacts the aromatic-sorbent at a temperature of generally 20°–300° C. (68°–572° F.), and preferably 100°–200° C. (212°–392° F.), preferably at a pressure from atmospheric pressure to a pressure effective to maintain the aromatic-flush stream and the displaced aromatic-raffinate components in a liquid phase at the chosen temperature, and a liquid hourly space velocity of generally 1–10 $hr^{-1}$, and preferably 1–3 $hr^{-1}$. The flow direction of the aromatic-flush stream through the aromatic-sorbent may be upflow, down flow, or radial flow. More preferably, the temperature for aromatics flushing is essentially the same as the temperature for aromatics sorption. The flow direction of the aromatic-flush stream may be counter-flow to the flow direction of the aromatic-feed stream, but the preferred direction is co-current. The phase of the aromatic-flush stream through the aromatic-sorbent bed may be liquid phase, vapor phase, or a mixture of liquid and vapor phases. During flushing, the aromatic-flush effluent stream is preferably routed to the paraffin-feed of the paraffin-sorptive separation zone, preferably as a mixture with the paraffin-feed stream. Alternatively, the aromatic-flush effluent stream is routed to the aromatic-feed stream to a bed of aromatic-sorbent.

The drawings illustrate two embodiments of the invention. For clarity in describing the inventive concept, various subsystems and apparatus associated with the operation of the process have not been shown. These items include flow and pressure control valves, pumps, temperature and pressure monitoring systems, vessel internals, etc., which may be of customary design. These representations of these embodiments are not intended to exclude from the scope of the inventive concept those other embodiments which are the result of reasonable and normal modification of these embodiments.

Referring now to FIG. 1, a paraffin-feed stream comprising a mixture of both iso- and normal $C_{10}$ and $C_{14}$ paraffins enters the paraffin-sorptive separation zone 14 through line 10. The paraffin-feed stream also contains co-boiling aromatic hydrocarbons. The paraffin-feed stream is passed through at least a portion of a fixed bed of crystalline aluminosilicates which selectively sorb normal paraffins and simulates the use of a moving bed sorption system.

A liquid stream referred to herein as a paraffin-extract stream and comprising the preferentially sorbed normal paraffins and the co-boiling aromatics of the paraffin-feed stream and also normal pentane, isooctane, and para-xylene, which are three compounds of the paraffin-desorbent stream and the paraffin-flush stream, is the aromatic-feed stream used in the process. The paraffin-extract stream is removed from the paraffin sorptive separation zone 14 in line 16 and passed into an aromatics removal zone 18 that is in sorption mode. This aromatics removal zone is maintained at conditions effective to remove a portion of the co-boiling aromatics, which are the aromatic-extract components, in the entering aromatic-feed stream. The aromatic-feed stream contains a low concentration, preferably less than 5 vol-% of the aromatic-desorbent component, which is para-xylene, in order that the paraxylene not interfere or compete with the sorption of co-boiling aromatics on the aromatic-sorbent. The aromatics removal zone produces an aromatic-raffinate stream removed in line 12 and passed into a fractionation column 30, called the paraffin-extract column. Compared to the aromatic-feed stream in line 16, the aromatic-raffinate stream in line 12 contains more of the aromatic-desorbent component, which is also the heaviest boiling of the three compounds in the paraffin-desorbent stream and paraffin-flush stream.

The paraffin-extract column 30 is maintained at conditions effective to separate the entering aromatic-raffinate stream into a net bottoms stream removed in line 28, a sidecut stream removed in line 44, and an overhead vapor stream removed in line 32. The net bottoms stream conaprises the normal paraffins which were removed from the feed stream in the paraffin-sorptive separation zone 14 and is substantially free of the other hydrocarbons present in the paraffin-extract stream. The liquid sidecut stream comprises all three compounds of the paraffin-desorbent stream and the paraffin-flush stream. The overhead vapor stream of the paraffin-extract column comprises the two lightest of the three compounds of the paraffin-desorbent stream and the paraffin-flush stream, and only a negligible concentration of the heaviest of the three compounds of the paraffin-desorbent stream and the paraffin-flush stream. The overhead vapor stream is passed through a condenser not shown and is then directed into an overhead receiver 34. The liquid which collects in this overhead receiver is removed in line 36 and divided into a first portion which is returned to the paraffin-extract column as reflux in line 38 and a second portion removed in line 40.

A liquid stream referred to herein as a paraffin-raffinate stream is removed from the paraffin-sorptive separation zone 14 in line 24. This stream comprises isoparaffins which were not preferentially sorbed, co-boiling aromatic hydrocarbons which were not preferentially sorbed or were flushed from, the aromatic sorbent. As described previously, most of the co-boiling aromatics in the paraffin-feed stream are not sorbed in the paraffin-sorbent particles, and consequently co-boiling aromatics are present in the paraffin-raffinate stream along with other non-sorbed compounds, such as isoparaffins. The paraffin-raffinate stream also contains the three compounds of the paraffin-desorbent stream and the paraffin-flush stream. The paraffin-raffinate stream is passed into a fractionation column 82, which is called the paraffin-raffinate column. This paraffin-raffinate column 82 is operated under conditions effective to separate the entering materials into a net bottoms stream removed in line 88, a liquid sidecut stream removed in line 48, and an overhead vapor stream removed in line 80. The net bottoms stream comprises the higher boiling isoparaffins and co-boiling aromatics. The liquid sidecut stream comprises all three compounds of the paraffin-desorbent stream and the paraffin-flush stream. The overhead vapor stream comprises the two lightest compounds of the three compounds of the paraffin-desorbent stream and the paraffin-flush stream, and only a negligible concentration of the heaviest of the three compounds of the paraffin-desorbent stream and the paraffin-flush stream. The overhead vapor stream is passed through a condenser not shown and into an overhead receiver 78. The liquid collected in this overhead receiver is withdrawn through line 76 and separated into a first portion which is returned to the raffinate column in line 84 as reflux and a second portion removed in line 60.

The hydrocarbon sidecut stream flowing through line 44 and the hydrocarbon sidecut stream flowing through line 48 are combined and passed through line 64 to a fractionation column 66, called the paraffin-desorbent column. This paraffin-desorbent column 66 is operated at conditions to produce a net bottoms stream removed in line 68 and an overhead vapor stream removed in line 52. The paraffin-desorbent column is operated at conditions to reject substantially all of the entering heaviest hydrocarbon as a component of the net bottoms stream through line 68 and to reject substantially all of the entering lightest hydrocarbon as a component of the overhead vapor stream passed through line 52. Therefore, the net bottoms stream of the paraffin-desorbent column 66 that flows through the line 68 comprises the heaviest boiling and the intermediate boiling of the three compounds of the paraffin-desorbent stream and the paraffin-flush stream. The net bottoms stream flowing through the line 68 is substantially free of the lightest boiling compound. On the other hand, the overhead vapor stream of paraffin-desorbent column 66 that flows through the line 52 comprises the lightest boiling and the intermediate boiling, and is substantially free of the heaviest boiling, of the three compounds. The overhead vapor stream is passed the line 52 to the paraffin-raffinate column 82.

The hydrocarbon streams flowing through lines 40 and 60 are combined and passed through line 46. The stream in line 46 is divided into a first portion that is returned to the paraffin sorptive separation zone 14 through line 22 as the paraffin-desorbent stream and a second portion that is passed through line 54. This second portion, which is also called the aromatic-flush stream, is passed into an aromatics removal zone 56 that is in flushing mode. This aromatics removal zone 56 is maintained at conditions effective to remove a portion of the aromatic-raffinate components from the interstitial void volume and non-selective pore volume of the aromatic sorbent, but without desorbing the co-boiling aromatics from the aromatic-sorbent.

This flushing step produces an aromatic-flush effluent stream that is removed through line 58, combined with the aromatic-raffinate stream flowing through the line 12, and passed to the paraffin-extract column 30 through the line 20. Two less-preferred options for routing this aromatic-flush effluent stream from the zone 56 are, on the one hand, to combine it with the paraffin-feed stream 10 and pass it to the paraffin-sorptive separation zone 14, and on the other hand to combine it with the paraffin-extract stream 16 and pass it to the aromatics removal zone 18. These options are less-preferred because they may increase the capital expense of the process because the paraffin sorptive separation zone 14 or the aromatics removal zone 18 may need to be designed for the higher throughput due to the flow of the aromatic-flush effluent stream. Moreover, these options can produce sudden changes in the composition of the streams entering either the paraffin-sorptive separation zone 14 or the aromatics removal zone 18, and these sudden changes may have adverse effects on the performance of either zone. Although a blend tank can be used to mix the aromatic-flush effluent stream and the stream with which it is combined in order to minimize sudden changes in composition, a blend tank itself is an additional capital expense that is avoided by the flow scheme shown in the drawing.

The net bottoms stream of the paraffin-desorbent column 66 that passes through the line 68 is divided into a first portion that is returned to the paraffin-sorptive separation zone 14 through line 26 as the paraffin-flush stream and a second portion that is passed through line 70. This second portion, which is also called the aromatic-desorbent stream, is passed into an aromatics removal zone 72 that is in desorption mode. This aromatics removal zone 72 is maintained at conditions effective to remove a portion of the co-boiling aromatics, which are the aromatic-extract components, that are sorbed onto the aromatic-sorbent. The aromatic-extract stream comprises the co-boiling aromatics, and the heaviest boiling and the intermediate boiling of the three compounds in the paraffin-desorbent stream and the paraffin-flush stream. This aromatic-extract stream is passed through the line 74 and to the paraffin-raffinate column 82 at a point below the sidecut draw-off point for line 48.

Sorbent beds 18, 56 and 72 are interchanged in a regular cycle. Once the aromatic-sorbent in the position of bed 18 is loaded with sorbed co-boiling aromatics, it is moved to the position of bed 56 where it remains while or until the normal paraffins are flushed. From there, it is moved to the position of bed 72 where it remains while or until the co-boiling aromatics are desorbed. From there, it is moved back to the position of bed 18 for another sorption step, thereby completing the cycle. The period of time that the aromatic-sorbent remains in each position could vary. Preferably, the sorption step, the flushing step, and the desorption step are all of equal duration.

Figure 2:
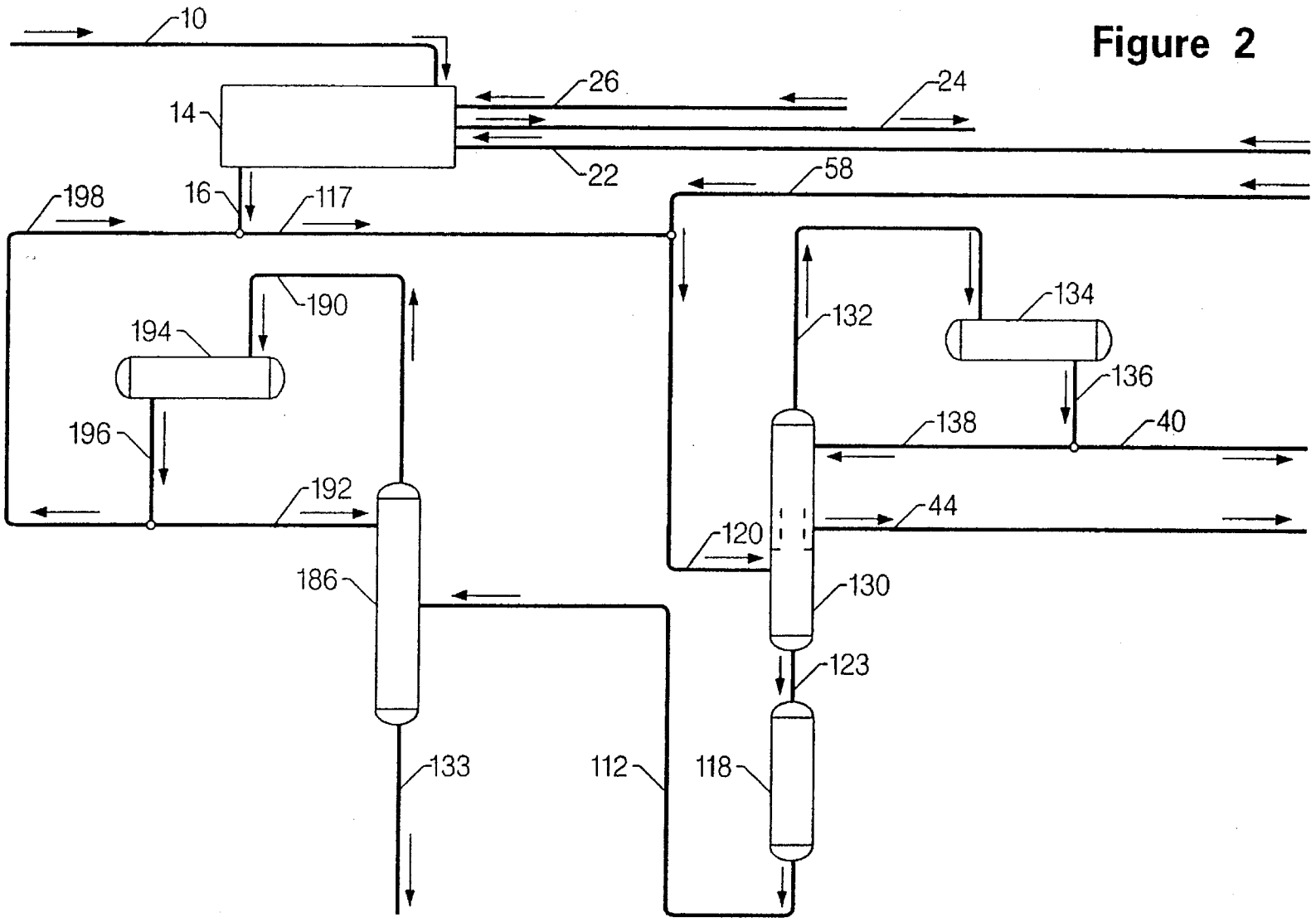
FIG. 2 is a simplified process flow diagram of another embodiment of the invention, wherein an aromatics removal zone sorbs aromatics from the normal-paraffin-containing stream that exits the extract column of a process for separating normal paraffins and iso-paraffins.

FIG. 2 illustrates an embodiment of the invention where the co-boiling aromatics are removed from the bottom stream leaving the paraffin-extract column, in contrast to FIG. 1 where the co-boiling aromatics are removed from the charge stream entering the paraffin-extract column. Despite this difference, the process depicted in FIG. 2 is very similar to the process depicted in FIG. 1, and consequently parts of FIG. 1 correspond directly to parts of FIG. 2. Corresponding parts in FIGS. 1 and 2 have been given the same index numbers. Accordingly, in the process depicted in FIG. 2, the lines 22, 24, 26, 40, 44 and 58 interconnect with other lines and equipment as shown in FIG. 1 which, for the sake of brevity, are not shown in FIG. 2. Likewise, in order to avoid repetitious description, the detailed description of the process of FIG. 2 that follows does not repeat the previous detailed description of the parts of the process of FIG. 1 that are not shown in FIG. 2.

Referring now to FIG. 2, a paraffin-feed stream enters the paraffin sorptive separation zone 14 through line 10. The paraffin feed stream is passed through a fixed bed of paraffin-sorbent. This bed of paraffin-sorbent is operated in a manner which simulates the use of a moving bed sorption system.

A paraffin-extract stream comprising the preferentially sorbed normal paraffins and the co-boiling aromatics of the paraffin-feed stream and also normal pentane, isooctane, and paraxylene, which are three compounds of the paraffin-desorbent stream and the paraffin-flush stream used in the process. The paraffin-extract stream is removed from the paraffin sorptive separation zone 14 in line 16 and is passed through lines 117 and 120 to a fractionation column 130, called the paraffin-extract column. The paraffin-extract column 130 produces a net bottoms stream removed in line 123, a sidecut stream removed in line 144, and an overhead vapor stream removed in line 132. The net bottoms stream comprises the normal paraffins and the co-boiling aromatics of the feed stream.

The net bottoms stream is passed to an aromatics removal zone 118 that is in sorption mode and, for that reason, the net bottoms stream is also called the aromatic-feed stream. The aromatics removal zone 118 removes a portion of the co-boiling aromatics in the entering aromatic-feed stream while desorbing the aromatic-desorbent component from the aromatic-sorbent, and produces an aromatic-raffinate stream removed in line 112 and passed into a fractionation column 186, called the aromatic-raffinate column. The aromatic-raffinate stream comprises the normal paraffins of the feed stream and the aromatic-desorbent component. The aromatic-desorbent component is the heaviest boiling of the three compounds in the paraffin-desorbent stream and the paraffin-flush stream, but it is lighter boiling than the normal paraffins. The aromatic-raffinate column 186 is maintained at conditions effective to separate the aromatic-raffinate stream into a net bottoms stream removed in line 133 and an overhead vapor stream removed in line 190.

The net bottoms stream of the aromatic-raffinate column 186 comprises the normal paraffins which were removed from the feed stream in the paraffin sorptive separation zone 114 and is substantially free of the other hydrocarbons present in the paraffin-extract stream. The overhead vapor of the aromatic-raffinate column 186 comprises the heaviest boiling of the three compounds in the paraffin-desorbent stream and the paraffin-flush stream. The overhead vapor stream is passed through a condenser not shown and is then directed to an overhead receiver 194. The liquid which collects in this overhead receiver 194 is removed in line 196 and divided into a first portion which is returned to the aromatic-raffinate column as reflux in line 192 and a second portion removed in line 198. This second portion combines with the paraffin-extract stream from line 116 and flows through lines 117 and 120 to the paraffin-extract column 130.

The overhead vapor stream in line 132 of the paraffin-extract column 130 is passed through a condenser not shown and is then directed into an overhead receiver 134. The liquid in this overhead receiver is removed in line 136 and divided into a first portion in line 138 and a second portion removed in line 40.

EXAMPLE

The following example is intended to further illustrate the subject process. This illustration of an embodiment of the invention is not meant to limit the claims of this invention to the particular details disclosed herein. This example is based on engineering calculations and actual operating experience with similar processes.

A paraffin-feed stream derived from a hydrotreated kerosene may be charged through a rotary valve to a fixed bed paraffin-sorption zone located in two vertical chambers. The paraffin-feed stream may be passed into the paraffin-sorption zone at a temperature of about 350° F. (177° C.) and a pressure of about 350 psig (24.8 atm.) The use of a moving bed of paraffin-sorbent may be simulated as described above. The paraffin-feed stream may contain $C_{10}$ to $C_{14}$ normal paraffins various other hydrocarbons, including aromatic hydrocarbons having the same boiling point range as the normal paraffins. The paraffin-desorbent stream charged to the rotary valve may be a mixture of isooctane and n-pentane. The paraffin-flush stream passed into the rotary valve may be a mixture of isooctane and paraxylene. The paraffin-flush stream and the paraffin-desorbent stream may be charged to the rotary valve at the same temperature and pressure as the paraffin-feed stream.

The paraffin-raffinate stream removed from the paraffin-sorption zone may be passed through a mixing drum to smooth out composition fluctuations and then into the paraffin-raffinate column. The flow scheme of the process may be similar to that shown in FIG. 1, except that there is no aromatics-flushing step. This column may be operated at an overhead pressure of about 20 psig (1.36 atm.) and an overhead vapor temperature of about 214° F. (101° C.). The net overhead stream removed from the paraffin-raffinate column may comprise n-pentane and isooctane. The net sidecut stream of the paraffin-raffinate column comprises n-pentane, isooctane, and paraxylene. The net bottoms stream of the paraffin-raffinate column may contain $C_{10}$ to $C_{14}$ paraffins and raffinate components of the paraffin-feed stream.

The paraffin-extract stream may contain 23.76 wt-% normal paraffins, 40.40 wt-% isooctane, 34.10 wt-% n-pentane, 1.70 wt-% paraxylene, and 0.04 wt-% aromatic hydrocarbons. The paraffin-extract stream, which may also be referred to as the aromatic-feed stream, may be passed through an aromatic-sorbent bed oilrated for aromatics sorption at a temperature of 350° F. (177° C.). a pressure of 350 psig, and a LHSV of 2 $hr^{-1}$ The sorbent may sorb aromatic hydrocarbons and paraxylene from the paraffin-extract stream. The purified paraffin-extract stream, which may also be referred to as the aromatic-raffinate stream, may contain 23.78 wt-% normal paraffins, 40.43 wt-% isooctane, 34.12 wt-% n-pentane, 1.67 wt-% paraxylene, and 50 w-ppm aromatic hydrocarbons.

The purified paraffin-extract stream may be passed into the paraffin-extract column. This column may be operated at an overhead pressure of about 20 psig (1.36 atm.) and an overhead vapor temperature of about 214° F. (101° C.). The net overhead stream removed from the paraffin-extract column may comprise n-pentane and isooctane. The net sidecut stream may be a mixture of n-pentane, isooctane, and paraxylene. The net bottoms stream of the paraffin-extract column may be removed at a temperature of about 493° F. (256° C.) and may contain $C_{10}$ to $C_{14}$ normal paraffins and 207 w-ppm aromatic hydrocarbons.

The net sidecut streams from the paraffin-raffinate column and the paraffin-extract column may be passed to a desorbent column. The net overhead stream removed from the desorbent column may contain n-pentane and isooctane and the net bottoms stream contains 65.19 wt-% isooctane and 34.81 wt-% paraxylene. A portion of the net bottoms stream may be the aromatic-desorbent stream and may be passed through an aromatic-sorbent bed of an aromatics removal zone that is loaded with co-boiling aromatics and paraxylene. The aromatics removal zone may be operated for aromatics desorption at a temperature of 350° F. (177° C.), a pressure of 350 psig, and a LHSV of 2 $hr^{-1}$. The co-boiling aromatics may be desorbed from the aromatic-sorbent in the aromatics removal zone. The effluent stream, which may also be referred to as the aromatic-extract stream, may contain 63.31 wt-% isooctane, 36.63 wt-% paraxylene, and 0.01 wt-% other aromatic hydrocarbons. The effluent stream may be passed to the paraffin-raffinate column, and the co-boiling aromatics may leave the paraffin-raffinate column as a component in the net bottoms stream.

What is claimed is:

1. A method of removing co-boiling aromatic hydrocarbons using a bed of a solid sorbent in a process for separating normal paraffinic hydrocarbons from a feed stream of normal paraffinic hydrocarbons, isoparaffinic hydrocarbons, and co-boiling aromatic hydrocarbons, wherein said co-boiling aromatic hydrocarbons have boiling points within the boiling point range of said normal paraffinic hydrocarbons, which method comprises the steps of:

a) passing a paraffin-feed stream comprising an isoparaffinic hydrocarbon having more than 6 carbon atoms per molecule, a normal paraffinic hydrocarbon having the same number of carbon atoms as said isoparaffinic hydrocarbon, and a co-boiling aromatic hydrocarbon to a fixed first bed of a solid first sorbent containing a first compound in a paraffin sorption step, sorbing said normal paraffinic hydrocarbon and said co-boiling aromatic hydrocarbon within said first sorbent of said first bed, and withdrawing a paraffin-raffinate stream comprising said isoparaffinic hydrocarbon and said first compound from said first bed;

b) passing a paraffin-desorbent stream comprising said first compound to said first bed in a paraffin desorption step, desorbing said normal paraffinic hydrocarbon and said co-boiling aromatic hydrocarbon from said first sorbent within said first bed, and withdrawing a paraffin-extract stream comprising said normal paraffinic hydrocarbon, said co-boiling aromatic hydrocarbon, and said first compound from said first bed;

c) passing at least a portion of said paraffin-extract stream to an aromatics removal zone comprising a fixed second bed of a solid second sorbent in a aromatic sorption step, desorbing a second compound from said second bed while sorbing said co-boiling aromatic hydrocarbon within said second bed, and withdrawing from said aromatics removal zone a first product stream comprising said normal paraffinic hydrocarbon, a first recycle stream comprising said first compound, and a second recycle stream comprising said second compound;

d) passing at least a portion of said paraffin-raffinate stream to a first separation zone, and recovering from said first separation zone a second product stream comprising said isoparaffinic hydrocarbon and said co-boiling aromatic hydrocarbon, a third recycle stream comprising said first compound, and a fourth recycle stream comprising said second compound;

e) passing an aromatic-desorbent stream comprising at least a portion of at least one of said second recycle stream and said fourth recycle stream to a fixed third bed of said solid second sorbent in an aromatic desorption step, desorbing said co-boiling aromatic hydrocarbon within said third bed while sorbing said second compound within said third bed, and withdrawing therefrom an aromatic-extract stream comprising said co-boiling aromatic hydrocarbon and said second compound;

f) passing at least a portion of said aromatic-extract stream to said first separation zone;

g) recovering at least a portion of at least one of said first recycle stream and said third recycle stream as said paraffin-desorbent stream; and h) periodically interchanging said second and said third fixed beds in said aromatic sorption and aromatic desorption steps.

2. A method of removing co-boiling aromatic hydrocarbons using a bed of a solid sorbent in a process for separating normal paraffinic hydrocarbons from a feed stream of normal paraffinic hydrocarbons, isoparaffinic hydrocarbons, and co-boiling aromatic hydrocarbons, wherein said co-boiling aromatic hydrocarbons have boiling points within the boiling point range of said normal paraffinic hydrocarbons, which method comprises the steps of:

a) passing a paraffin-feed stream comprising an isoparaffinic hydrocarbon having more than 6 carbon atoms per molecule, a normal paraffinic hydrocarbon having the same number of carbon atoms as said isoparaffinic hydrocarbon, and a co-boiling aromatic hydrocarbon to a fixed first bed of a solid first sorbent containing a first compound, sorbing said normal paraffinic hydrocarbon and said co-boiling aromatic hydrocarbon within a paraffin sorption zone within said first sorbent of said first bed, and withdrawing a paraffin-raffinate stream comprising said isoparaffinic hydrocarbon and said first compound from said first bed;

b) passing a paraffin-desorbent stream comprising said first compound to said first bed at a different point than said paraffin-feed stream is passed to said first bed, desorbing said normal paraffinic hydrocarbon and said co-boiling aromatic hydrocarbon from said first sorbent within a paraffin desorption zone within said first bed, and withdrawing a paraffin-extract stream comprising said normal paraffinic hydrocarbon, said co-boiling aromatic hydrocarbon, and said first compound from said first bed at a different point than said paraffin-raffinate stream is withdrawn from said first bed;

c) simulating the utilization of a moving bed of said first sorbent by maintaining a net fluid flow through said first bed and by periodically moving in a unidirectional pattern the points at which said paraffin-feed stream and said paraffin-desorbent stream are passed to said first bed and the points at which said paraffin-extract stream and said paraffin-raffinate stream are withdrawn from said first bed to gradually shift the location of said paraffin sorption and paraffin desorption zones within said first bed;

d) passing at least a portion of said paraffin-extract stream to an aromatics removal zone comprising a fixed second bed of a solid second sorbent in a aromatic sorption step, desorbing a second compound from said second bed while sorbing said co-boiling aromatic hydrocarbon within said second bed, and withdrawing from said aromatics removal zone a first product stream comprising said normal paraffinic hydrocarbon, a first recycle stream comprising said first compound, and a second recycle stream comprising said second compound;

e) passing at least a portion of said paraffin-raffinate stream to a first separation zone, and recovering from said first separation zone a second product stream comprising said isoparaffinic hydrocarbon and said co-boiling aromatic hydrocarbon, a third recycle stream comprising said first compound, and a fourth recycle stream comprising said second compound;

f) passing an aromatic-desorbent stream comprising at least a portion of at least one of said second recycle stream and said fourth recycle stream to a fixed third bed of said solid second sorbent in an aromatic desorption step, desorbing said co-boiling aromatic hydrocarbon within said third bed while sorbing said second compound within said third bed, and withdrawing therefrom an aromatic-extract stream comprising said co-boiling aromatic hydrocarbon and said second compound;

g) passing at least a portion of said aromatic-extract stream to said first separation zone;

h) recovering at least a portion of at least one of said first recycle stream and said third recycle stream as said paraffin-desorbent stream; and i) periodically interchanging said second and said third fixed beds in said aromatic sorption and aromatic desorption steps.

3. The method of claim 2 further characterized in that in Step (d) an aromatic-raffinate stream comprising said normal paraffinic hydrocarbon, said first compound, and said second compound is withdrawn from said second bed, said aromatic-raffinate stream is passed to a second separation zone comprising a fractionation column, said first recycle stream is withdrawn from the overhead of said second separation zone, said second recycle stream is withdrawn as a sidecut from said second separation zone, and said first product stream is withdrawn from the bottom of said second separation zone.

4. The method of claim 2 wherein said paraffin-desorbent stream, said paraffin-extract stream, said paraffin-raffinate stream, said first recycle stream, and said third recycle stream comprise said second compound, and wherein said portion of said paraffin-extract stream that is passed to said second bed has a concentration of said second compound of less than 5 vol.-%.

5. The method of claim 2 further characterized in that an aromatic-flush stream comprising at least a portion of said paraffin-desorbent stream, at least a portion of said first recycle stream, or at least a portion of said third recycle stream is passed to a fixed fourth bed 15 of said solid second sorbent in an aromatic flushing step, said normal paraffinic hydrocarbon is flushed from the interstitial void volume of said fourth bed, an aromatic-flush effluent stream comprising said normal paraffinic hydrocarbon and said first compound is withdrawn from said fourth bed, at least a portion of said aromatic-flush effluent stream is passed to said aromatics removal zone, said second fixed bed in said aromatic sorption step is periodically changed to said fourth fixed bed in said aromatic flushing step, said fourth fixed bed is periodically changed to said third fixed bed in said aromatic desorption step, and said third fixed bed is periodically changed to said second fixed bed.

6. The method of claim 5 wherein said paraffin-desorbent stream, said paraffin-extract stream, said paraffin-raffinate stream, said first recycle stream, said third recycle stream, and said aromatic-flush stream comprise said second compound, and wherein said aromatic-flush stream has a concentration of said second compound of less than 2 mol.-%.

7. The method of claim 2 further characterized in that in Step (d) said portion of said paraffin-extract stream that is passed to said aromatics removal zone is passed to a second separation zone comprising a fractionation column, said first recycle stream is withdrawn from the overhead of said second separation zone, said second recycle stream is withdrawn as a sidecut from said second separation zone, an aromatic-feed stream is withdrawn from the bottom of said second separation zone, said aromatic-feed stream is passed to said second bed, an aromatic-raffinate stream comprising said normal paraffinic hydrocarbon and said second compound is withdrawn from said second bed, said aromatic-raffinate stream is passed to a third separation zone comprising a fractionation column, an overhead stream comprising said second compound is withdrawn from said third separation zone, said overhead stream is passed to said second separation zone, and said first product stream is withdrawn from the bottom of said third separation zone.

8. The method of claim 2 further characterized in that a paraffin-flush stream comprising a third compound is passed to said first bed at a different point than said paraffin-feed stream and said paraffin-desorbent stream are passed to said first bed, said isoparaffinic hydrocarbon is flushed from the interstitial void volume of said first bed within a paraffin flushing zone within said first bed, the point at which said paraffin-flush stream is passed to said first bed is periodically moved in a unidirectional pattern to gradually shift the location of said paraffin flushing zone within said first bed, said paraffin-extract stream, said paraffin-raffinate stream, said second recycle stream, and said fourth recycle stream comprise said third compound, and said paraffin-flush stream comprises at least a portion of said second recycle stream or at least a portion of said fourth recycle stream.

9. The method of claim 8 wherein said portion of said second recycle stream or said portion of said fourth recycle stream is passed to a second separation zone, from which are recovered an overhead stream comprising said second compound and said third compound and having a first concentration of said second compound, and a bottom stream comprising said second compound and said third compound and having a second concentration of said second compound that is greater than said first concentration, said paraffin-flush stream comprises a first portion of said bottom stream, and said aromatic-desorbent stream comprises a second portion of said bottom stream.

10. The method of claim 2 wherein said paraffin-desorbent stream, said paraffin-extract stream, said paraffin-raffinate stream, said first recycle stream and said second recycle stream comprise a third compound comprising an isoparaffin and having a boiling point at least 20° F. or lower than the lowest boiling point of said normal paraffinic hydrocarbon, said isoparaffinic hydrocarbon, and said co-boiling aromatic hydrocarbon.

11. The method of claim 10 wherein said second recycle stream, said fourth recycle stream, and said aromatic-extract stream comprises said third compound.

12. The process of claim 2 wherein said first compound has a boiling point at least 30° F. lower than the lowest boiling point of said normal paraffinic hydrocarbon, said isoparaffinic hydrocarbon, and said co-boiling aromatic hydrocarbon.

13. The process of claim 2 wherein said second compound has a boiling point at least 10° F. lower than the lowest boiling point of said normal paraffinic hydrocarbon, said isoparaffinic hydrocarbon, and said co-boiling aromatic hydrocarbon.

14. The process of claim 2 wherein said first compound has a boiling point at least 20° F. lower than said second compound.

15. A method of removing co-boiling aromatic hydrocarbons using a bed of a solid sorbent in a process for separating normal paraffinic hydrocarbons from a feed stream of normal paraffinic hydrocarbons, isoparaffinic hydrocarbons, and co-boiling aromatic hydrocarbons, wherein said co-boiling aromatic hydrocarbons have boiling points within the boiling point range of said normal paraffinic hydrocarbons, which method comprises the steps of:

a) passing a paraffin-feed stream comprising an isoparaffinic hydrocarbon having more than 6 carbon atoms per molecule, a normal paraffinic hydrocarbon having the same number of carbon atoms as said isoparaffinic hydrocarbon, and a co-boiling aromatic hydrocarbon to a paraffin sorption zone within a fixed first bed of a solid first sorbent containing normal pentane and isooctane, sorbing said normal paraffinic hydrocarbon and said co-boiling aromatic hydrocarbon within a paraffin sorption zone within said first sorbent of said first bed, passing para-xylene from a paraffin flushing zone within said first bed to said paraffin sorption zone, and withdrawing a paraffin-raffinate stream comprising said isoparaffinic hydrocarbon, normal pentane, isooctane, and para-xylene from said first bed;

b) passing a paraffin-flush stream comprising isooctane and para-xylene to said first bed at a different point than said paraffin-feed stream is passed to said paraffin flushing zone of said first bed, and flushing said isoparaffinic hydrocarbon from the interstitial void volume of said first bed within said paraffin flushing zone within said first bed;

c) passing a paraffin-desorbent stream comprising normal pentane and isooctane to said first bed at a different point than said paraffin-feed stream and said paraffin-flush stream are passed to said first bed, desorbing said normal paraffinic hydrocarbon and said co-boiling aromatic hydrocarbon from said first sorbent within a paraffin desorption zone within said first bed, and withdrawing a paraffin-extract stream comprising said normal paraffinic hydrocarbon, said co-boiling aromatic hydrocarbon, normal pentane, isooctane, and para-xylene from said first bed at a different point than said paraffin-raffinate stream is withdrawn from said first bed;

d) simulating the utilization of a moving bed of said first sorbent by maintaining a net fluid flow through said first bed and by periodically moving in a unidirectional pattern the points at which said paraffin-feed stream, said paraffin-flush stream, and said paraffin-desorbent stream are passed to said first bed and the points at which said paraffin-extract stream and said paraffin-raffinate stream are withdrawn from said first bed to gradually shift the location of said paraffin sorption, paraffin flushing, and paraffin desorption zones within said first bed;

e) passing said paraffin-extract stream to a fixed second bed of a solid second sorbent in an aromatic sorption step, desorbing para-xylene from said second bed while sorbing said co-boiling aromatic hydrocarbon within said second bed, and withdrawing from said second bed an aromatic-raffinate stream comprising said normal paraffinic hydrocarbon, normal pentane, isooctane, and para-xylene;

f) passing said aromatic-raffinate stream to a first separation zone and recovering from said first separation zone a first overhead stream comprising normal pentane and isooctane, a first sidecut stream comprising normal pentane, isooctane, and para-xylene, and a first bottom stream comprising said normal paraffinic hydrocarbon;

g) passing said paraffin-raffinate stream to a second separation zone, and recovering from said second separation zone a second overhead stream comprising normal pentane and isooctane, a second sidecut stream comprising normal pentane, isooctane, and para-xylene, and a second bottom stream comprising said isoparaffinic hydrocarbon and said co-boiling aromatic hydrocarbon;

h) passing said first sidecut stream and said second sidecut stream to a third separation zone and recovering from said third separation zone a third overhead stream comprising normal pentane and isooctane and a third bottom stream comprising isooctane and para-xylene;

i) passing said third overhead stream to said second separation zone;

j) passing a first portion of said third bottom stream to a fixed third bed of said solid second sorbent in an aromatic desorption step, desorbing said co-boiling aromatic hydrocarbon within said third bed while sorbing para-xylene within said third bed, and withdrawing from said third bed an aromatic-extract stream comprising isooctane, paraxylene, and said co-boiling aromatic hydrocarbon;

k) passing said aromatic-extract stream to said second separation zone;

l) recovering a second portion of said third bottom stream as said paraffin-flush stream for Step (b);

m) passing a first portion of a combined stream comprising said first overhead stream in Step (f) and said second overhead stream in Step (g) to a fixed fourth bed of said solid second sorbent in an aromatic flushing step, flushing said normal paraffinic hydrocarbon from the interstitial void volume of said fourth bed, and withdrawing an aromatic-flush effluent stream comprising normal pentane, isooctane and said normal paraffinic hydrocarbon;

n) passing said aromatic-flush effluent stream to said first separation zone;

o) recovering a second portion of said combined stream as said paraffin-desorbent stream for Step (c); and p) periodically changing said second fixed bed in said aromatic sorption step to said fourth fixed bed in said aromatic flushing step, periodically changing said fourth fixed bed to said third fixed bed in said aromatic desorption step, and periodically changing said third fixed bed to said second fixed bed.

16. A method of removing co-boiling aromatic hydrocarbons using a bed of a solid sorbent in a process for separating normal paraffinic hydrocarbons from a feed stream of normal paraffinic hydrocarbons, isoparaffinic hydrocarbons, and co-boiling aromatic hydrocarbons, wherein said co-boiling aromatic hydrocarbons have boiling points within the boiling point range of said normal paraffinic hydrocarbons, which method comprises the steps of:

a) passing a paraffin-feed stream comprising an isoparaffinic hydrocarbon having more than 6 carbon atoms per molecule, a normal paraffinic hydrocarbon having the same number of carbon atoms as said isoparaffinic hydrocarbon, and a co-boiling aromatic hydrocarbon to a paraffin sorption zone within a fixed first bed of a solid first sorbent containing a normal pentane and isooctane, sorbing said normal paraffinic hydrocarbon and said co-boiling aromatic hydrocarbon within a paraffin sorption zone within said first sorbent of said first bed, passing para-xylene from a paraffin flushing zone within said first bed to said paraffin sorption zone, and withdrawing a paraffin-raffinate stream comprising said isoparaffinic hydrocarbon, normal pentane, isooctane, and para-xylene from said first bed;

b) passing a paraffin-flush stream comprising isooctane and para-xylene to said first bed at a different point than said paraffin-feed stream is passed to said paraffin flushing zone of first bed, and flushing said isoparaffinic hydrocarbon from the interstitial void volume of said first bed within said paraffin flushing zone within said first bed;

c) passing a paraffin-desorbent stream comprising normal pentane and isooctane to said first bed at a different point than said paraffin-feed stream and said paraffin-flush stream are passed to said first bed, desorbing said normal paraffinic hydrocarbon and said co-boiling aromatic hydrocarbon from said first sorbent within a paraffin desorption zone within said first bed, and withdrawing a paraffin-extract stream comprising said normal paraffinic hydrocarbon, said co-boiling aromatic hydrocarbon, normal pentane, isooctane, and para-xylene from said first bed at a different point than said paraffin-raffinate stream is withdrawn from said first bed;

d) simulating the utilization of a moving bed of said first sorbent by maintaining a net fluid flow through said first bed and by periodically moving in a unidirectional pattern the points at which said paraffin-feed stream, said paraffin-flush stream, and said paraffin-desorbent stream are passed to said first bed and the points at which said paraffin-extract stream and said paraffin-raffinate stream are withdrawn from said first bed to gradually shift the location of said paraffin sorption, paraffin flushing, and paraffin desorption zones within said first bed;

e) passing said paraffin-extract stream to a first separation zone and recovering therefrom a first overhead stream comprising normal pentane and isooctane, a first sidecut stream comprising normal pentane, isooctane, and para-xylene, and a first bottom stream comprising said normal paraffinic hydrocarbon and said co-boiling aromatic hydrocarbon;

f) passing said first bottom stream to a fixed second bed of a solid second sorbent in an aromatic sorption step, desorbing para-xylene from said second bed while sorbing said co-boiling aromatic hydrocarbon within said second bed, and withdrawing from said second bed an aromatic-raffinate stream comprising said normal paraffinic hydrocarbon and para-xylene;

g) passing said aromatic-raffinate stream to a second separation zone and recovering from said second separation zone a second overhead stream comprising para-xylene and a second bottom stream comprising said normal paraffinic hydrocarbon, and passing said second overhead stream to said first separation zone;

h) passing said paraffin-raffinate stream to a third separation zone, and recovering from said third separation zone a third overhead stream comprising normal pentane and isooctane, a second sidecut stream comprising normal pentane, isooctane, and para-xylene, and a third bottom stream comprising said isoparaffinic hydrocarbon and said co-boiling aromatic hydrocarbon;

i) passing said first sidecut stream and said second sidecut stream to a fourth separation zone and recovering from said fourth separation zone a fourth overhead stream comprising normal pentane and isooctane and a fourth bottom stream comprising isooctane and para-xylene;

j) passing said fourth overhead stream to said third separation zone;

k) passing a first portion of said fourth bottom stream to a fixed third bed of said solid second sorbent in an aromatic desorption step, desorbing said co-boiling aromatic hydrocarbon within said third bed while sorbing para-xylene within said third bed, and withdrawing from said third bed an aromatic-extract stream comprising isooctane, para-xylene, and said co-boiling aromatic hydrocarbon;

l) passing said aromatic-extract stream to said third separation zone;

m) recovering a second portion of said fourth bottom stream as said paraffin-flush stream for Step (b);

n) passing a first portion of a combined stream comprising said second overhead stream in Step (e) and said third overhead stream in Step (h) to a fixed fourth bed of said solid second sorbent in an aromatic flushing step, flushing said normal paraffinic hydrocarbon from the interstitial void volume of said fourth bed, and withdrawing an aromatic-flush effluent stream comprising normal pentane, isooctane and said normal paraffinic hydrocarbon;

o) passing said aromatic-flush effluent stream to said first separation zone;

p) recovering a second portion of said combined stream as said paraffin-desorbent stream for Step (c); and q) periodically changing said second fixed bed in said aromatic sorption step to said fourth fixed bed in said aromatic flushing step, periodically changing said fourth fixed bed to said third fixed bed in said aromatic desorption step, and periodically changing said third fixed bed to said second fixed bed.

* * * * *